US012290139B2

(12) United States Patent
Tuli

(10) Patent No.: US 12,290,139 B2
(45) Date of Patent: May 6, 2025

(54) MOTORIZED WALKING SHOES

(71) Applicant: Raja Singh Tuli, Montreal (CA)

(72) Inventor: Raja Singh Tuli, Montreal (CA)

( * ) Notice: Subject to any disclaimer, the term of this patent is extended or adjusted under 35 U.S.C. 154(b) by 0 days.

(21) Appl. No.: 18/222,003

(22) Filed: Jul. 14, 2023

(65) Prior Publication Data

US 2023/0389645 A1 Dec. 7, 2023

Related U.S. Application Data

(62) Division of application No. 15/815,582, filed on Nov. 16, 2017, now abandoned.

(51) Int. Cl.

| | |
|---|---|
| ***A43B 3/34*** | (2022.01) |
| ***A43B 13/14*** | (2006.01) |
| ***A63C 17/10*** | (2006.01) |
| ***A63C 17/12*** | (2006.01) |

(52) U.S. Cl.

CPC ..... *A43B 3/34* (2022.01); *A43B 13/141* (2013.01); *A63C 17/10* (2013.01); *A63C 17/12* (2013.01)

(58) Field of Classification Search

CPC ..... A63C 17/10; A63C 17/12; A43B 3/0005; A43B 13/141

See application file for complete search history.

(56) References Cited

U.S. PATENT DOCUMENTS 3,876,032 A * 4/1975 Ferino ..... A63C 17/12 180/9.1
4,508,187 A * 4/1985 Wenzel ..... A63C 17/12 180/181
5,390,958 A * 2/1995 Soo ..... A63C 17/10 280/844
5,413,380 A * 5/1995 Fernandez ..... A63C 17/10 280/844
5,580,096 A * 12/1996 Freilich ..... A63C 17/10 280/844
5,730,241 A * 3/1998 Shyr ..... A63C 17/10 180/181
5,934,706 A * 8/1999 Yiu ..... A63C 17/10 280/11.26
6,059,062 A * 5/2000 Staelin ..... B60L 3/0092 180/181
6,428,050 B1 * 8/2002 Brandley ..... A63C 17/12 280/809
9,027,690 B2 * 5/2015 Chavand ..... A63C 17/12 280/11.115

(Continued)

*Primary Examiner* — Erez Gurari

(57) ABSTRACT

A motorized personal transportation article is described which transports a person by wearing a pair of power-assisted motorized shoes, wherein the shoes provide an increase in a user's walking speed in a forward walking action through supplementary motion of moving or propelling means based on an intended walking speed of the user, such that when a user's intended walking speed changes or when a user intends to substantially decelerate or immobilize, the speed of the supplementary motion can be adjusted before the step is completed. The sole of each of the shoes houses at least one plate coupled to moving or propelling means such as conveyor assemblies, and the moving or propelling means are designed to neutralize forces acting to disrupt the operation of the moving or propelling means during a forward walking action or the balance and comfort of the user.

9 Claims, 13 Drawing Sheets

(56) References Cited

U.S. PATENT DOCUMENTS

| | | | | |
|---|---|---|---|---|
| 9,295,302 | B1 * | 3/2016 | Reed | A43B 3/128 |
| 9,526,977 | B2 * | 12/2016 | Edney | A63C 17/04 |
| 9,925,453 | B1 * | 3/2018 | Tuli | A43C 19/00 |
| 2005/0082099 | A1 * | 4/2005 | Tuli | A43B 3/34 180/181 |
| 2009/0101427 | A1 * | 4/2009 | Baldwin | B62D 55/104 180/181 |
| 2011/0059664 | A1 * | 3/2011 | Poichot | A63C 17/10 441/74 |
| 2023/0389645 | A1 * | 12/2023 | Tuli | A63C 17/10 |

* cited by examiner

MOTORIZED WALKING SHOES

CROSS-REFERENCE TO RELATED APPLICATIONS

This application is a divisional application of and incorporates by reference in its entirety U.S. application Ser. No. 15/815,582, filed Nov. 16, 2017 and entitled "MOTORIZED WALKING SHOES", which is a continuation-in-part of application Ser. No. 15/353,813 filed on Nov. 17, 2016.

BACKGROUND OF THE INVENTION

Field of the Invention

The present invention relates to motorized personal transport means, more specifically, the field of power-assisted footwear to transport a user. The present invention also relates to active means of transport, which are operated through user actions.

Description of the Related Art

Power-assisted footwear enabling travel or motion of a user is known as a means of personal transportation, although it has generally been limited to the concept of powered or motorized skates, where roller skates or in-line skates, thereby involving a skating motion. Prior art examples of these endeavors include U.S. Pat. Nos. 3,876,032, 4,508,187, 5,236,058, 5,797,466 and 6,059,062. In these cases, when the power-assisted footwear is worn by a user, the natural walking movement of the user contributes either little or not at all to the user motion required to prompt or properly engage with the power-assisted footwear. Moreover, in most of the prior art cases, the user of the power-assisted footwear has limited control over the speed of the footwear. Unlike power-assisted footwear that is specifically designed to avoid natural walking movements and that rather involve a relatively more sporty motion like skating, the present invention is designed to supplement a user's natural walking movement.

U.S. Pat. No. 9,027,690 by Dijon describes another type of power-assisted footwear. This teaching integrates a hinge system that pivots an undersole mechanical belt when the foot bends during a walking action. While this device is useful as a personal transport means, it is different from the present invention and lacks various features and functional benefits of the present invention.

In addition to being user-friendly, the present invention provides the operational advantage of power-assisted motion supplementing a user's walking motion, such that a user actually moves at a faster speed than the speed whereat he or she walks without altering the user's stability or requiring any movement other than a normal, forward walking action.

BRIEF SUMMARY OF THE INVENTION

The present invention consists of articles of motorized personal transport means that move a person when worn and activated. As an exemplary embodiment, the present invention is constituted of a pair of power-assisted motorized shoes, although shoes could be replaced by equivalent footwear such as sandals, slippers, boots, rain boots, and so on. The present invention is meant to be prompted without requiring any user action other than the user's normal, forward walking action. In operation, the present invention provides a range-bounded, user-selected speed increment to the walking speed of the user without negatively affecting the user's balance or comfort. According to one embodiment of the present invention, when a sole of the motorized walking shoes is in contact with an underlying surface, the supplementary motion provided by the shoes varies on the basis of the user's real-time walking intention.

The present embodiments generally relate to articles of footwear that include motorized systems that can be configured. In a principal embodiment, the soles of two shoes paired together each house a processing unit, power storage, and at least one sensor. In another embodiment, at least one sensor can be attached to the user's body instead of, or in addition to, the sensors comprised in the shoe soles.

In a principal embodiment of the present invention, a plate is installed under each of the toe and the heel areas of the shoe soles. For each shoe sole, the two plates are connected by a flexible portion located under a crumple zone, in which the shoe bends during a forward walking action. At least one conveyor assembly is coupled to each of the plates. In one embodiment, each shoe sole is coupled to only one conveyor assembly, which is coupled to both plates. Each conveyor assembly comprises a conveyor belt, wrapped over and clasping at least a set of wheels or rollers. Among all the conveyor assemblies that are coupled to a same plate, at least one set of wheels or rollers is connected to a motor in order to drive the conveyor assembly or assemblies forward. A single motor can be connected to wheels or rollers of more than one conveyor assembly. Similarly, a single motor can be connected to multiple sets of wheels or rollers of a single conveyor assembly. In a principal embodiment, each shoe comprises two motors, each associated to one of the plates and driving forward the respective conveyor assemblies that are coupled to the associated plate. In an alternate embodiment, a single motor in each shoe drives forward all of the shoe's conveyor assemblies.

The speed of a motor, which in turn controls the speed of the conveyor assembly or assemblies to which it is coupled, can be determined on the basis of the user's intended walking speed. In turn, a user's intended walking speed can be assessed by, or calculated from, the speed that is strictly contributed by the user's walking motion. Either the user's intended walking speed or the speed that is strictly contributed by the user's walking motion, or both, can be deduced by one of the processing units housed in a shoe sole. Information and data from the sensors, such as geographic information, speed data or body movement collected by a motion sensor, can be sent to one of the processing units to deduce the user's intended walking speed or the speed that is strictly contributed by the user's walking motion. When a change in a user's intended walking speed is sensed during a step, the processing units synchronously adjust (through the motors) the speed of all the conveyors in both shoe soles, such that the user's actual walking speed can be adjusted to the new intended walking speed before the step is completed. Furthermore, within a same pair of shoes, the processing units housed in each shoe sole communicate wirelessly with each other to maintain speed synchronicity between the shoe soles and monitor the motion of the conveyor assemblies. In a principal embodiment, the processing units also control all electrical and mechanical operations of the present invention. In an alternate embodiment, all electrical and mechanical operations are controlled remotely.

In accordance with the present invention, the conveyor assemblies or equivalent components have mechanisms to handle any external force that can be generated upon impact of the shoe sole with an underlying surface. The conveyor assemblies or equivalent components are designed to operate continuously, without any disruption despite intermittent external forces that may be contributive or opposite to the motion of the conveyor assemblies or equivalent components.

In another embodiment, in order to further instances of bending over instances of twisting, the flexible portion is reinforced by equipping it with ribs or at least one hinge.

In another embodiment, a plurality of wheels or rollers is distributed along the conveyor belt, in which the wheels or rollers can be equally spaced. Further, additional supporting shafts and gears may be incorporated into the plates in order to obtain a more rigid structure or a more effective setup.

In another embodiment, either the plate in a toe area of the shoe or the plate in a heel area of the shoe, or both, is made of flexible materials that allow a certain degree of bending or twisting, yet to a lesser extent than the flexible portion can bend or twist. Moreover, in this embodiment, the front and rear plates can be made of identical or distinct materials, so long as any plate that is bendable or twistable is relatively less bendable or twistable than the flexible portion.

In another embodiment, the front sections of conveyor assemblies or equivalent components that are coupled to the plate in a toe area of the shoes can be tilted upward with a fixed angle. In addition, the rear sections of conveyor assemblies or equivalent components that are coupled to the plate in a heel area of the shoes can be tilted upward with a fixed angle.

In another embodiment, multiple conveyor assemblies or equivalent components are coupled to the plates, which are made of relatively flexible materials, and the flexible portion has multiple hinges distributed along its length.

In another embodiment, the conveyor assemblies or equivalent components that are coupled to the front plate may be different in length, in width or in components from those that are coupled to the rear plate, so long as the conveyor assemblies or equivalent components that are coupled to a same plate are identical and substantially parallel to one another. In another embodiment, the plate in a toe area of the shoe and the plate in a heel area of the shoe can differ in shape.

In another embodiment, there is at least one shock absorber, such as a spring, that is distributed along the length of the conveyor assembly or assemblies coupled to a plate in a toe area of the shoe or to the conveyor assembly or assemblies coupled to a plate in a heel area of the shoe, or to both. The shock absorber(s) connect the plates with the sets of rollers or wheels that are clasped over by a conveyor belt.

In an additional embodiment, a single plate is connected to the sole of each paired shoe, aligned longitudinally from the toe area of the shoe to the heel area of the shoe. The single plate is coupled to at least one conveyor assembly or equivalent moving or propelling means also aligned longitudinally from the toe area of the shoe to the heel area of the shoe. Mechanical means connect the conveyor assemblies to the single plate. The preferred material of the single plate is determined so that it is twistable to a small extent or bendable, or both, while remaining sufficiently stiff to prevent substantial twisting. This way, the single plate cannot be twisted to a point that could potentially damage the shoe. In a further embodiment, the single plate is made of a plurality of plate portions and plate hinges, allowing the single plate to be bent without requiring the plate portions to be made of flexible materials.

BRIEF DESCRIPTION OF THE SEVERAL VIEWS OF THE DRAWINGS

The various embodiments of the present invention described herein can be better understood by those skilled in the art when the following detailed description is read with reference to the accompanying drawings. The components in the figures and graphs are not necessarily drawn to scale, and any reference numeral identifying an element in one drawing represents the same element throughout the drawings. The drawings are briefly described as follows.

DETAILED DESCRIPTION OF THE INVENTION

Mechanical Designs of the Shoes in a Principal Embodiment

The present invention relates to motorized personal transport means, more particularly, to a pair of power-assisted motorized shoes. The invention described herein is designed to be operated at its best in conjunction with a normal, forward walking action. A person skilled in the art would recognize that the present invention can also be used in conjunction with other forward moving actions, such as jogging, running, wobbling, tramping, and so on. The paired shoes have identical components integrated in their soles. Upon contact of a shoe sole with an underlying surface during a forward walking action, the shoe translates the user to a distance farther than without wearing it. In the present invention, the step length and the walking speed can increase without altering a normal walking action or disturbing a user's natural walking balance.

Figure 1:
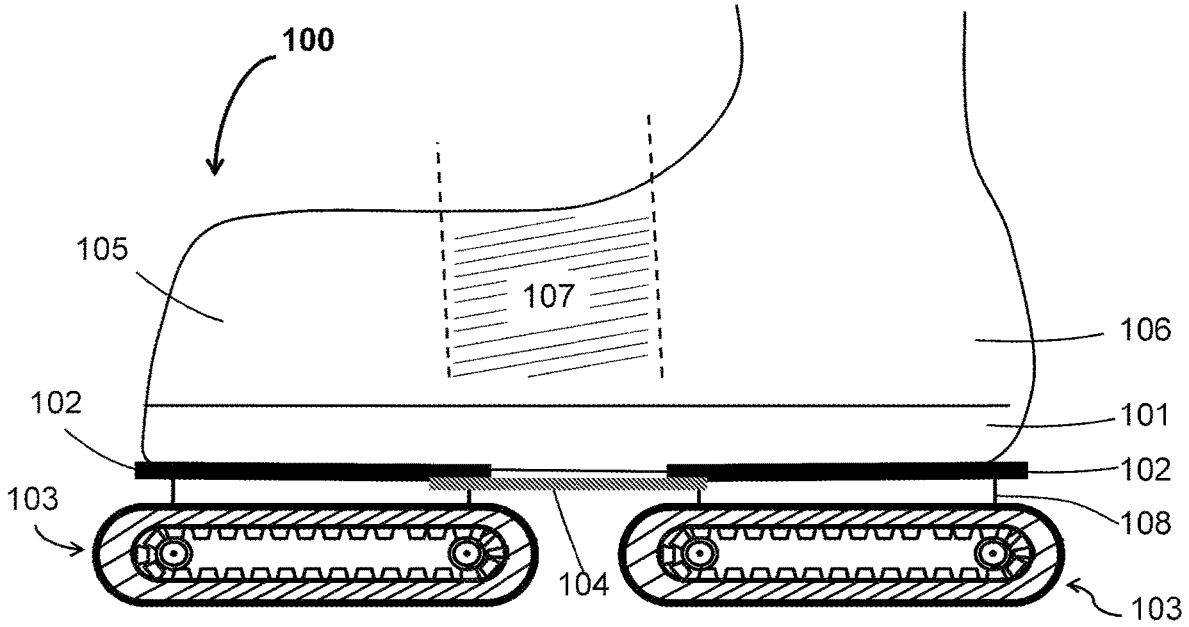
FIG. 1 illustrates a side elevation view of a shoe in accordance with the principal embodiment of the present invention.

In a principal embodiment of the present invention, with reference to FIG. 1, a sole 101 of a shoe 100 comprises a flexible portion 104 and two plates 102 that are relatively stiff, wherein each of the plates 102 is coupled to at least one conveyor assembly 103 or equivalent moving or propelling means. Mechanical means 108, such as hinges, anchors, nuts and bolts, screws, rivets and other fasteners known in the art, connect the conveyor assemblies 103 to the plates 102. The two plates 102, preferably made of metal such as aluminum, are respectively positioned at the toe area 105 and at the heel area 106 of the shoe 100, and they are connected together by the flexible portion 104. The flexible portion 104 is made of a relatively flexible material so that it can be bent or twisted, or both; preferably, the flexible portion 104 is a plastic sheet such as nylon. The flexible portion 104 is installed under the crumple zone 107—a part of the shoe 100 that bends along with the foot in a forward walking action. As each shoe 100 is paired with another shoe equipped in the same way, power storage, sensory devices and processing units (not shown) can be located in the soles 101 of each of two paired shoes 100 to ensure a synchronized speed of the conveyor assemblies 103 and activate their translation motions. The processing units in the soles 101 of the paired shoes 100 are in wireless communication with each other and with their sensors.

The flexible portion 104 is twistable or bendable, or both, because shoes 100 need to be bent along with the foot during a forward walking action. The flexible portion 104 facilitates bending the shoe 100 naturally in the crumple zone 107 during a forward walking motion, in which a torque is momentarily applied to the flexible portion 100 upon contact of the shoe 100 with an underlying surface. Bending and twisting the flexible portion 104 maintains the comfort of a natural forward walking action without negatively affecting the performance of the shoes 100. In a forward walking motion, the contact angle between the shoe 100 and the underlying surface varies from step to step due to a variety of factors, such as the profile of the terrain, changes in direction and the walking speed of the user. To accommodate the shoes 100 to this wide range of flexibility requirements while torque is exerted upon the flexible portion 104, the flexible portion 104 is made to withstand recurrent bending and twisting of various extents while yet reverting to its original shape once torque is eliminated. By confining a shoe's flexibility requirements to the flexible portion 104, the conveyor assemblies 103 do not need to be bendable or twistable at the level of the crumple zone 107. Should the conveyor assemblies 103 bend or twist when the shoe 100 bends, it could distort the motion and the balance of the conveyor assemblies 103. Therefore, the design of the flexible portion 104 in the present invention preserves a user's natural forward walking action and the balance of the user despite the fact that the conveyor assemblies 103, or equivalent moving or propelling mechanisms, are the only components of the shoes 100 physically in contact with the underlying surface.

Figure 2:
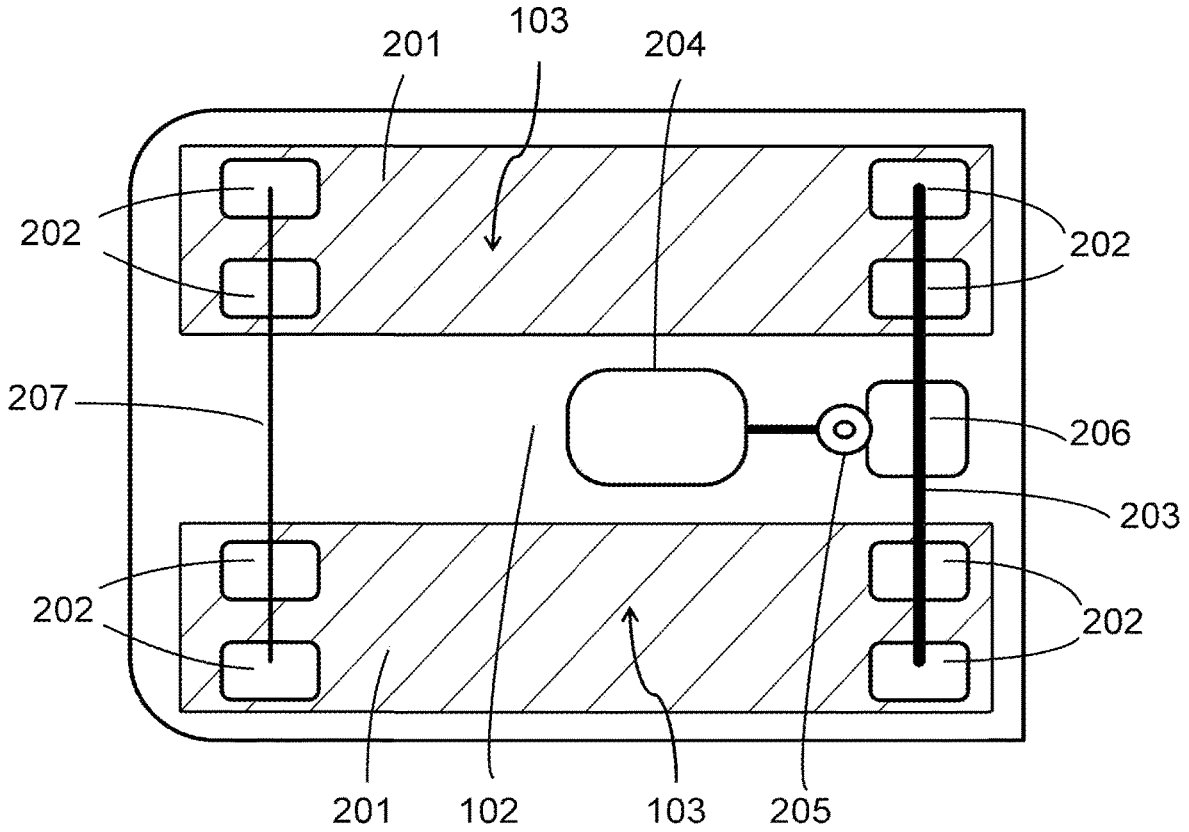
FIG. 2 illustrates a sectional view from a bottom angle of conveyor assemblies coupled to a plate in accordance with the principal embodiment of the present invention.

In an exemplary embodiment of the present invention, referred to in FIG. 2, translation motions of the shoes 100 are carried out by conveyor assemblies 103. In this example, two conveyor assemblies 103 coupled to a same plate 102 each comprise a conveyor belt 201 that is, in a preferred embodiment, advantageously notched. The conveyor belts 201 are each wrapped over and clasping at least a set of wheels or rollers 202. In one embodiment, the sets of wheels or rollers 202 are located near the front and rear ends of the conveyor belts 201. The conveyor belts 201 are preferably made of a thick layer of soft rubber or equivalent materials that act as a cushion to partially absorb the impact of a normal walking action on a foot. In a principal embodiment of the present invention, two identical conveyor assemblies 103 are coupled to a plate 102, each being installed along a longitudinal direction of the shoe 100. When there are multiple conveyor assemblies 103, they are preferably positioned parallel to each other in order to provide a lateral stability of the shoe 100. For each conveyor assembly 103, at least one of the sets of wheels or rollers 202 is connected to the rotary shaft 203 of a worm gear mechanism, which is powered by a motor 204. The worm gear mechanism comprises a worm 205 and a worm wheel 206 coupled to the motor 204 to drive the wheels or rollers 202 and impart a rotation of the conveyor belts 201 that translates the shoe 100 forward. Every conveyor assembly 103 coupled to a same plate 102 has a same speed, which is monitored and synchronized by processing units housed in each of the shoe soles 101. The processing units communicate continuously with each other by wireless means so that the speed of the conveyor assemblies 103 is synchronized and remains the same, respectively, for the conveyor assemblies 103 coupled to the plates 102 in the toe areas 105 of the paired shoes 100 and for the conveyor assemblies 103 coupled to the plates 102 in the heel areas 106 of the paired shoes 100.

A person skilled in the art would recognize that equivalent moving or propelling means can be used instead of conveyor assemblies, such as beltless rollers, beltless wheels, vibrating fingers—fingers coupled to the soles 101 of the shoes 100 that can move up and down to carry the shoes 100 forward—and so on.

Figure 3:
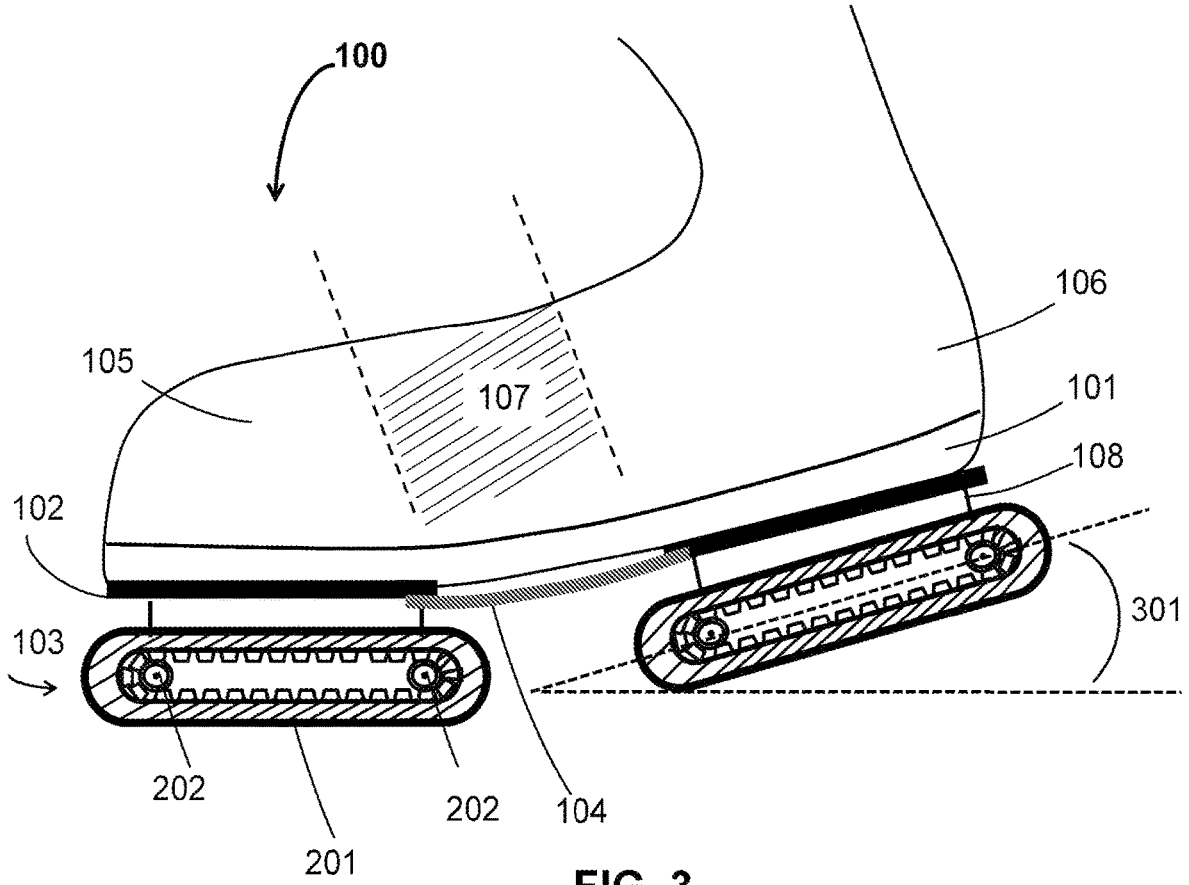
FIG. 3 illustrates a side elevation view of a shoe in accordance with the principal embodiment of the present invention wherein the conveyor assemblies that are coupled to a plate in the heel area of the shoe start breaking contact with an underlying surface as the heel is lifted in a forward walking action.

FIG. 3 illustrates the situation when a shoe 100 breaks contact with the underlying surface. Right before the moment a shoe 100 breaks contact with the underlying surface, the user has lifted the foot in a normal forward walking motion with an inclined angle 301, measured with respect to the underlying surface at the heel area 106 of the shoe 100. Due to the angular upward motion of the foot, an assistance force is generated, which is defined as a combination of an upward force and an angular force in favour of the movement of the conveyor assemblies 103 that are coupled to the plate 102 in the toe area 105 of the shoe 100. Being exerted on the conveyor assemblies 103 coupled to the plate 102 in the toe area 105 of the shoe 100, this assistance force can hazardously increase the speed of these conveyors assemblies 103 or may even cause belt slip if it is sufficiently large. To counter these potential effects, the conveyor assemblies 103 have a mechanism that maintains their motion speed at a synchronous preset speed despite the assistance force.

Similarly, in reaction to an angular downward stride of the foot in a normal forward walking action, a resistance force opposing the forward movement of the conveyor assemblies 103 is generated upon contact of the heel area 106 with the underlying surface. Should it not be taken into account, this resistance force, which is a combination of an angular force and a downward force exerted on the conveyor assemblies 103, would reduce the ongoing speed of the motor 204 and could cause backlash on the conveyor belts 201, stalling their motion or changing their speed suddenly when the resistance force is sufficiently large. Therefore, an anti-backlash mechanism needs to be included in the system, which mechanism is capable of preventing loss of speed and impeding uncontrolled reverse movements of the conveyor assemblies 103. As an exemplary embodiment of an anti-backlash mechanism, anti-backlash worm gears, whereby the axis of rotation of the worm 205 and the worm wheel 206 are positioned at a specific angle, may be implemented into the system. The anti-backlash mechanism can ensure that the conveyor assemblies 103 continuously and synchronously move at a preset speed without alterations when disturbances caused by this resistance force occur.

In a normal forward walking action, the contact surface of the shoe 100 with the underlying surface is continuously changing through the user's gait cycle. Therefore, the assistance force exerted on the conveyor assemblies 103 coupled to the plate 102 in a toe area 105 of the shoe 100 and the resistance force exerted on the conveyor assemblies 103 coupled to the plate 102 in the heel area 106 of the shoe 100 change in magnitude over time. Accordingly, the countervailing mechanisms are capable of countering the effects of the irregular external forces in order to keep the conveyor assemblies 103 moving at a preset speed synchronously. To that end, the countervailing mechanisms may be aided by sensory devices and computer-controlled actions.

The design of the principal embodiment of the present invention provides a particular benefit with respect to the assistance and resistance forces. In having two sets of conveyor assemblies 103, a first set in a toe area 105 of the shoe 100 and a second set in a heel area 105 of the shoe, the duration of the effects of resistance and assistance forces on the conveyor assemblies is reduced. Regarding the assistance force, its effects on the conveyor assemblies 103 in the heel area 106 of the shoe 100 do not last long since the conveyor assemblies 103 in the heel area 106 of the shoe 100 break contact with the underlying surface as soon as the heel area 106 is lifted up. Similarly, the conveyor assemblies 103 in the toe area 105 of the shoe 100 are less affected by the resistance force as their contact time with the underlying surface is reduced. In both cases, the flexible portion 104, by allowing the shoe 100 to bend at the crumple zone 107 with the foot motion, also assists in minimizing the duration of contact between the conveyor assemblies 103 and the underlying surface and thus diminishing the effects of the assistance and resistance forces.

Additional Embodiments for the Mechanical Designs of the Shoes

Figure 4:
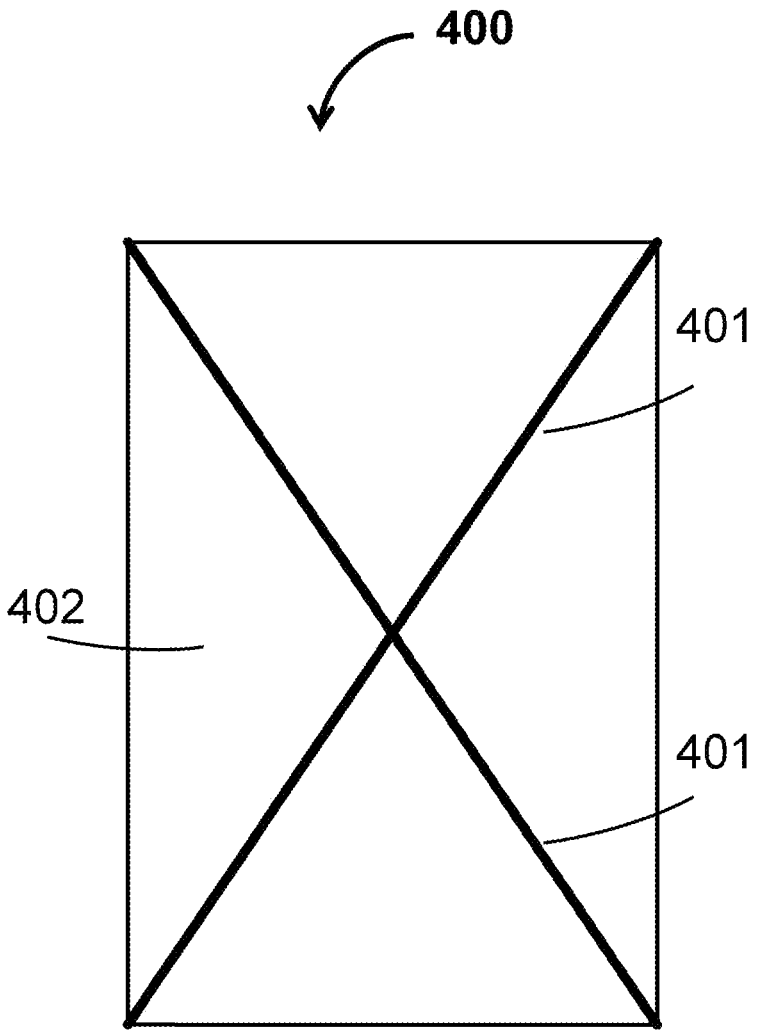
FIG. 4 illustrates a plan view of a reinforced flexible portion with ribs in accordance with an additional embodiment of the present invention.

In FIG. 4, an alternate embodiment of a reinforced flexible portion 400 equipped with ribs 401 is depicted. The reinforced flexible portion 400 equipped with ribs 401 bends and twists more easily than the flexible portion 104 described with respect to the principal embodiment. The reinforced flexible portion 400 equipped with ribs 401 is constituted of a flexible matrix 402 into which ribs 401 are molded, welded or embedded to make bending easier than twisting. The ribs 401 can be made from the same material as the flexible matrix 402 or from a different material are made from the same or a different material than the flexible matrix 402. As an exemplary embodiment illustrated in FIG. 4, the ribs 401 can extend up to the corners of the reinforced flexible portion 400 equipped with ribs 401 and merge at the center of the reinforced flexible portion 400 equipped with ribs 401. A person skilled in the art would recognize that similar arrangements with respect to the ribs 401 are known in the art and could alternately be integrated to the present invention.

Figure 5A:
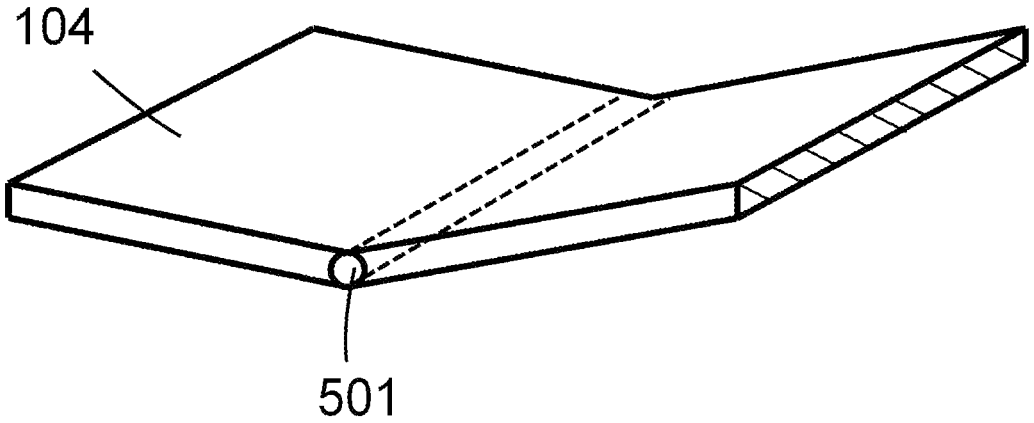
FIG. 5A illustrates a perspective view of a flexible portion with a hinge in accordance with an additional embodiment of the present invention.
Figure 5B:
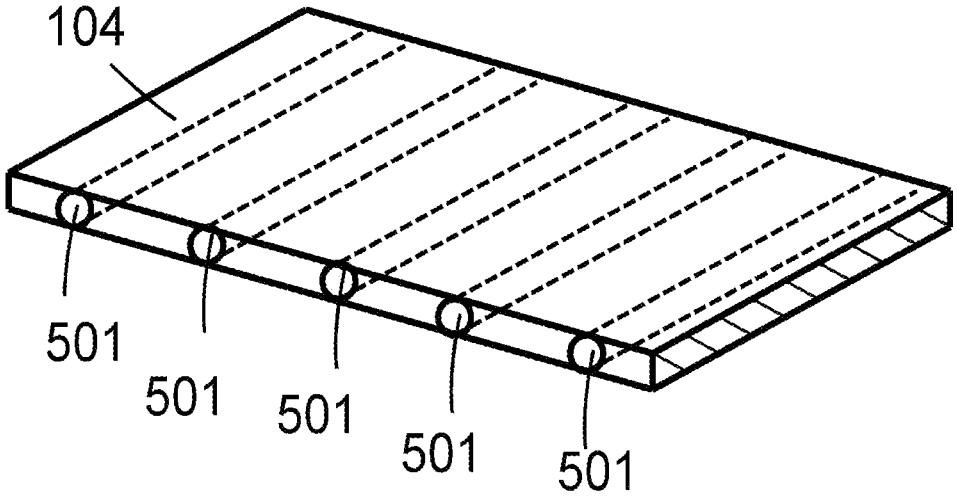
FIG. 5B illustrates a perspective view of a flexible portion with multiple hinges in accordance with an additional embodiment of the present invention.

In another embodiment, as shown in FIG. 5A, a hinge 501 that runs across the center of the flexible portion 104 is incorporated. With this hinge 501, the flexible portion 104 remains bendable and twistable for the shoe 100 to bend naturally during a forward walking action, but bending is made easier than twisting. In a further embodiment shown in FIG. 5B, a plurality of hinges 501 can be distributed along the length of the flexible portion 104 such that bending the flexible portion 104 is made significantly easier than twisting it.

Figure 6:
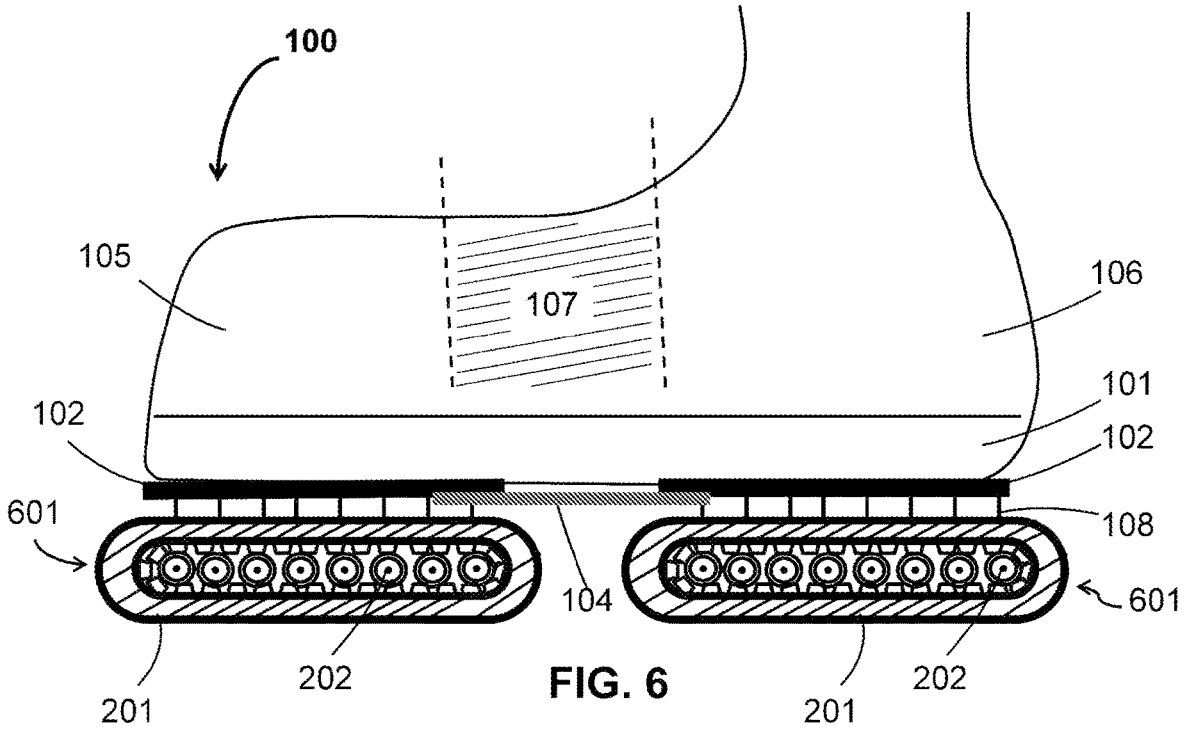
FIG. 6 illustrates a side elevation view of a shoe in accordance with an alternate embodiment of the present invention wherein conveyor assemblies comprise multiple sets of wheels or rollers that are each coupled to their corresponding plate.

In yet another embodiment of the present invention, as depicted in FIG. 6, multiple sets of wheels or rollers 202, equally spaced or not, can be distributed along the length of a conveyor belt 201 that is connected to either one of the plates 102. When multiple sets of wheels or rollers 202 are clasped by a conveyor belt 201, the resulting conveyor assemblies 601 that are coupled to a same plate 102 are always identical and parallel to each other. In order to provide a more rigid structure or a more effective setup, an additional supporting shaft 207 (in FIG. 2) and supplementary gears that connect together a plurality of wheels and rollers 202 may be incorporated into the conveyor assemblies 601, although it is not necessary for these additional components to be power-assisted. The wheels or rollers 202 that are not directly connected to the motor 204 are passively driven by the motion of the conveyor belt 201, taking into account that speed of all the conveyors assemblies 601 coupled to a same plate 102 is identical and synchronized.

The operating principle of the present invention is that the conveyor assemblies 103 contribute to the distance traveled by the user on top of the distance traveled strictly by the user's walking motion. Hence, when the shoe 100 is in contact with an underlying surface, the present invention transports the shoe 100 farther and forward until contact with the underlying surface is broken. Accordingly, it is desirable that the contact surface of the conveyor assemblies 103 with the underlying surface is as broad as possible for the present invention because it benefits to the efficiency and stability of the conveyor assemblies 103 to transport the user forward. In a normal forward walking action, the heel area 106 of the shoe 100 initially touches the underlying surface at a slanted angle. Accordingly, with respect to the conveyor assemblies 103 coupled to a plate 102 in a heel area 106 of the shoe 100, the particular section that aligns with this slanted angle will have a greater contact surface with the underlying surface upon contact than the other sections of the conveyor assemblies 103 coupled to a plate 102 in the heel area 106. Similarly, there is an angular contact at the toe area 105 when a user lifts his or her foot. In one embodiment of the present invention, the plates 102 are slightly bendable or twistable, or both, allowing the angle of the conveyor assemblies 103 coupled to the plates 102 to be respectively closer to the contact angles of the toe area 105 and the heel area 106 of the shoe with the underlying surface. The impact-related twist and bend could occur in any direction depending on the profile of the terrain, the user's stride angle and the stride force. Therefore, in this embodiment, various extents of twisting and bending of the plate 102 are desirable to ensure that the surface of the conveyor assemblies 103 remains closely parallel to the underlying surface in any circumstances.

Figure 7A:
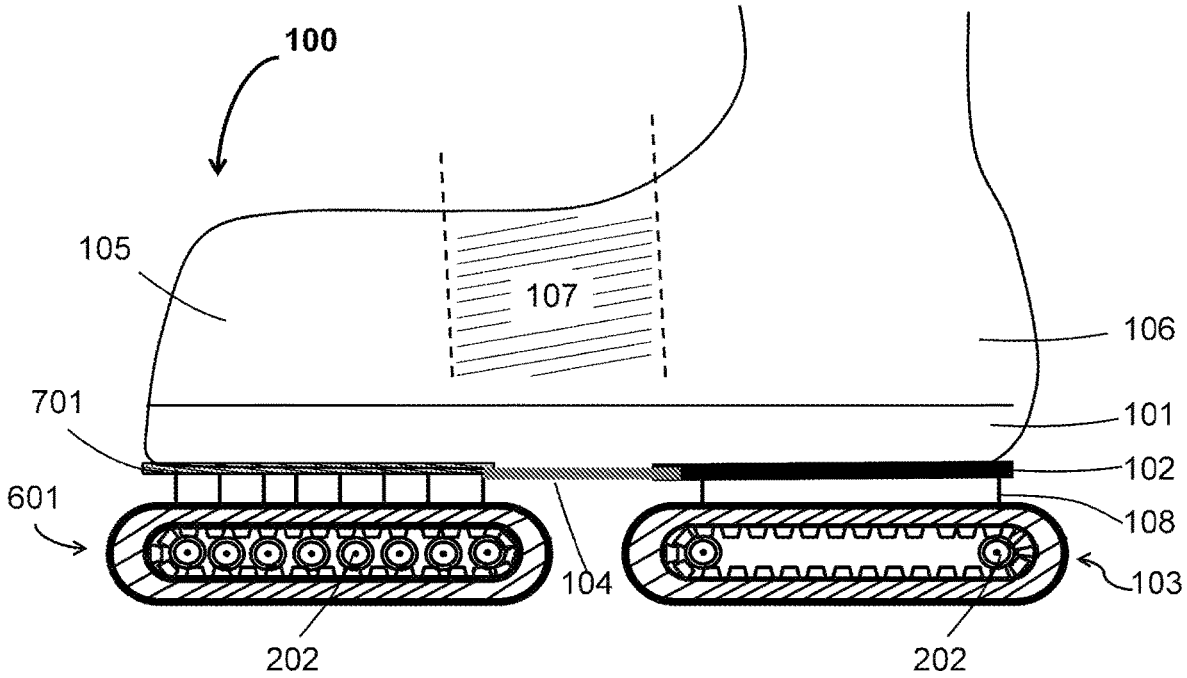
FIG. 7A illustrates a side elevation view of a shoe in accordance with an alternate embodiment of the present invention wherein the conveyor assemblies coupled to a plate in a toe area of the shoe comprise multiple sets of wheels or rollers that are each coupled to the plate in a toe area of the shoe, which plate that is made of relatively flexible material.

Accordingly, in another embodiment illustrated in FIG. 7A, the front plate 701 is made of a flexible material so that it can be twisted or bent, or both. In addition, the conveyor assemblies 601 that are coupled to the front plate 701 have multiple sets of wheels or rollers 202 in order to obtain a greater contact surface between the conveyor assemblies 601 coupled to the front plate 701 and the underlying surface when the toe area 105 is in angular contact with the underlying surface. The preferred material of the front plate 701 is determined so that it is bendable or twistable, or both, but to a lesser extent than the flexible portion 104. This way, the front plate 701 remains relatively stiff when compared to the flexible portion 104.

Figure 7B:
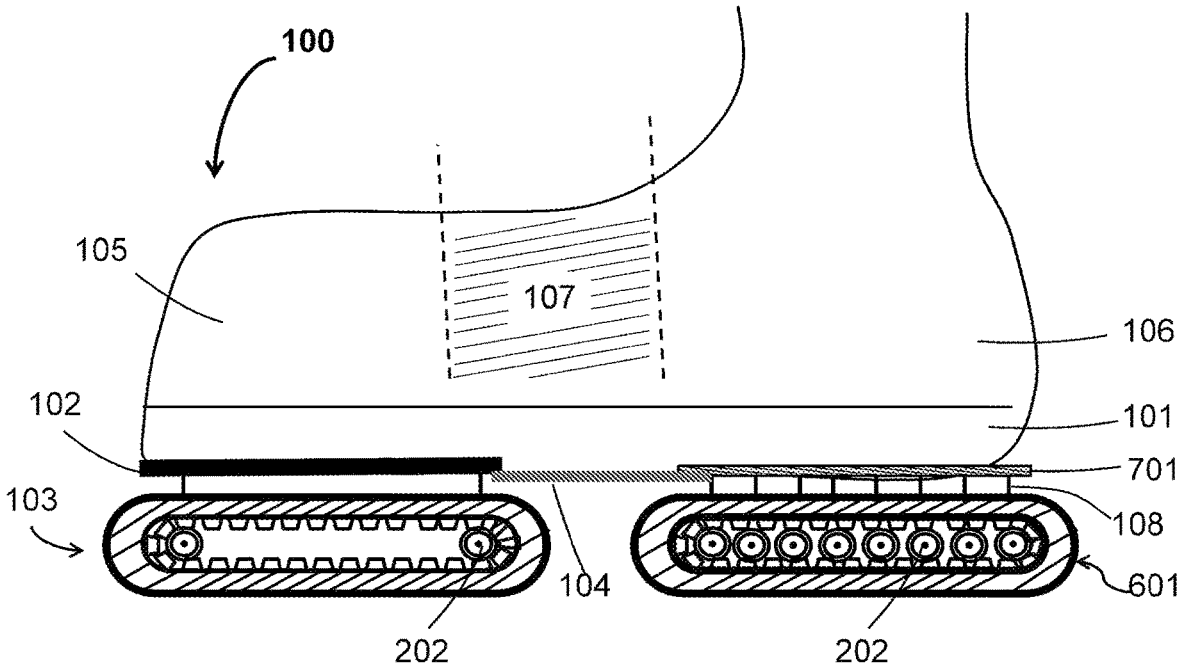
FIG. 7B illustrates a side elevation view of a shoe in accordance with an alternate embodiment of the present invention wherein the conveyor assemblies coupled to a plate in a heel area of the shoe comprise multiple sets of wheels or rollers that are each coupled to the plate in a heel area of the shoe, which plate that is made of relatively flexible material.

Similarly, in another embodiment illustrated in FIG. 7B, the rear plate 701 is made of a flexible material so that it can be bent or twisted, or both, but to a lesser extent than the flexible portion 104. This way, the front plate 701 remains relatively stiff when compared to the flexible portion 104. In addition, the conveyor assemblies 601 that are coupled to the front plate 701 have multiple sets of wheels or rollers 202 in order to obtain a greater contact surface between the conveyor assemblies 601 coupled to the front plate 701 and the underlying surface when the heel area 106 is in angular contact with the underlying surface.

In a further embodiment, conveyor assemblies 601 with multiple sets of wheels or rollers 202 are coupled to both the front and the rear plates 701 in order to obtain a greater contact surface between the conveyor assemblies 601 coupled to the front and rear plates 701 and the underlying surface during a forward walking action. Both the front and rear plates 701 are made of a flexible material so that they can be twisted or bent, or both, but to a lesser extent than the flexible portion 104. This way, both the front and rear plates 701 remain relatively stiff when compared to the flexible portion 104.

Figure 8A:
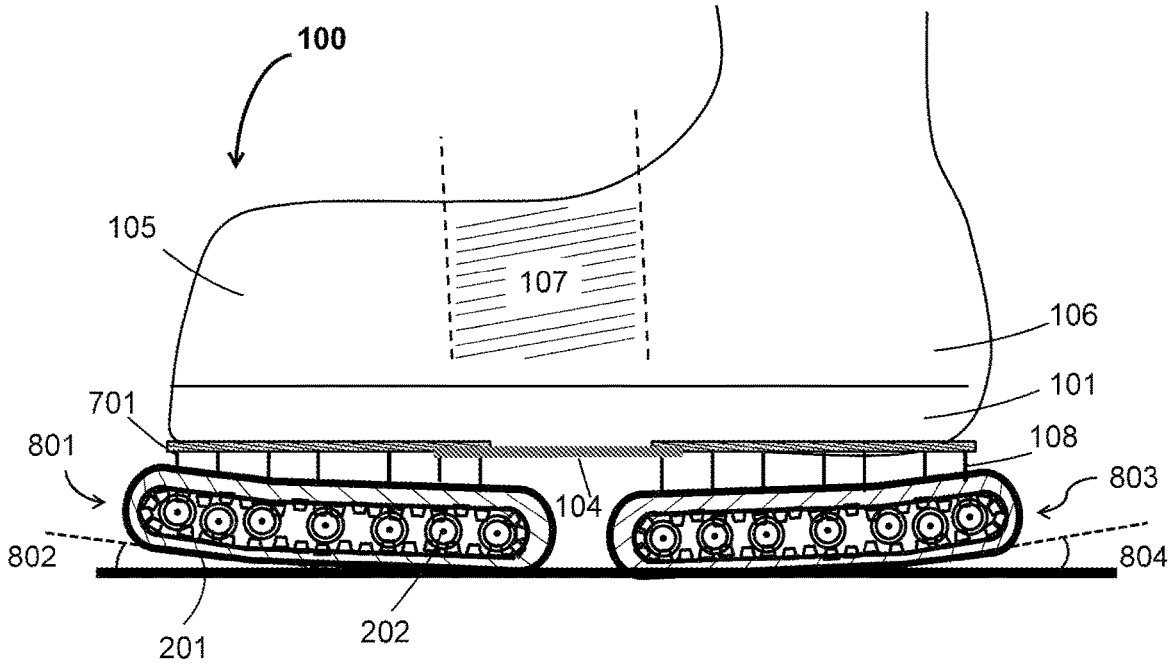
FIG. 8A illustrates a side elevation view of a shoe in accordance with an alternate embodiment of the present invention wherein conveyor assemblies with tilted ends are coupled to the front and rear plates, which are made of flexible material.
Figure 8B:
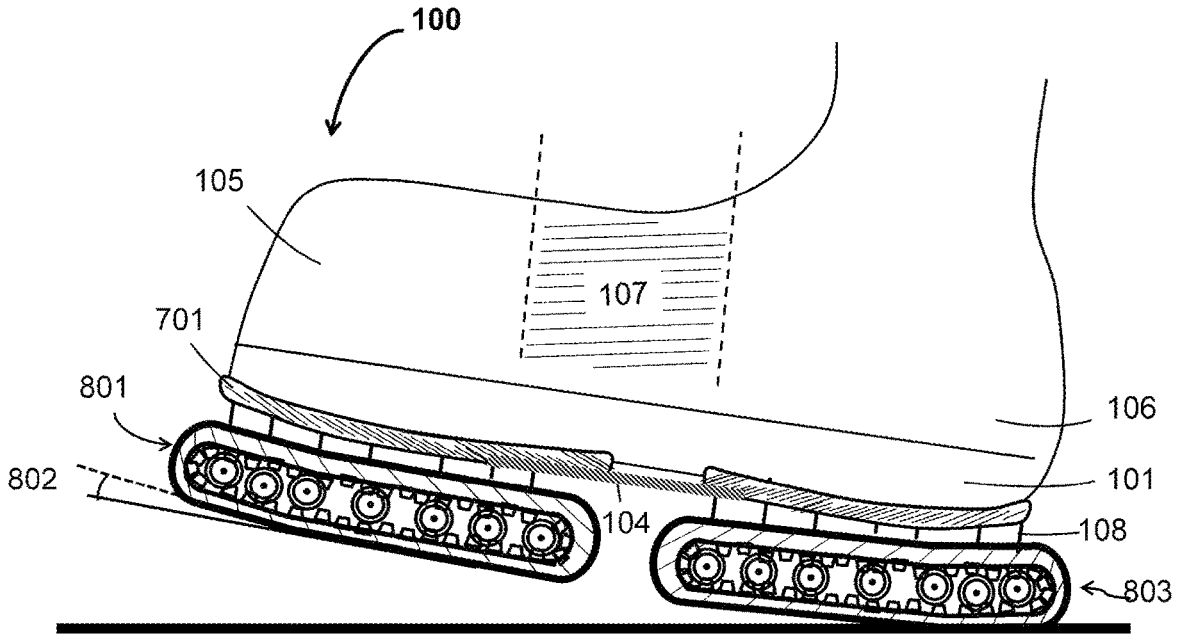
FIG. 8B illustrates a side elevation view of a shoe in accordance with an alternate embodiment of the present invention where conveyor assemblies with tilted ends are coupled to the front and rear plates, and wherein a rear section of the conveyors assemblies coupled to the plate in the heel area of the shoe is making contact with an underlying surface as the shoe is put down in a forward walking action.
Figure 8C:
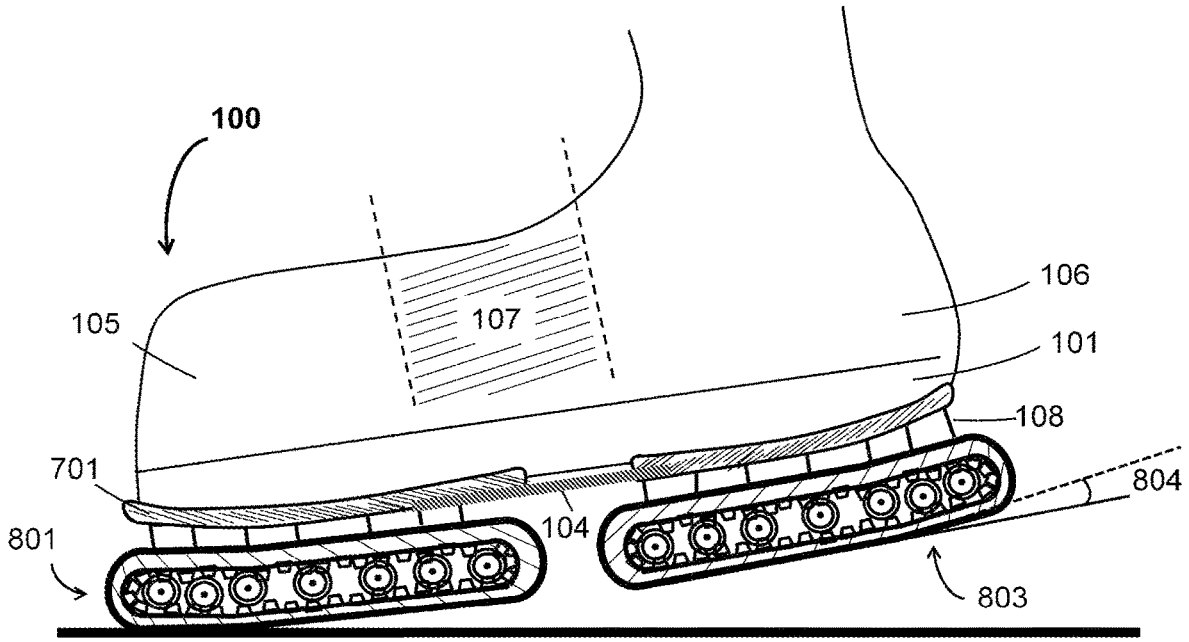
FIG. 8C illustrates a side elevation view of a shoe in accordance with an alternate embodiment of the present invention where conveyor assemblies with tilted ends are coupled to the front and rear plates, and wherein a front section of the conveyors assemblies coupled to the plate in the toe area of the shoe is making contact with an underlying surface as the shoe is being lifted in a forward walking action.

In yet another embodiment as shown in FIG. 8A, angled conveyor assemblies 801 coupled to a plate 701 in a toe area 105 of the shoe 100 have their front sections tilted upward in a certain angle 802, while angled conveyor assemblies 803 coupled to a plate 701 in a heel area 106 of the shoe 100 have their rear sections tilted upward in a certain angle 804. With these tilted sections, the contact surface between the conveyor assemblies 801 and 803 and the underlying surface can be enlarged. In one embodiment, the titled angles 802 and 804 are fixed. The tilted angles 802 and 804 can be different from each other. To facilitate a proper motion of the angled conveyor assemblies 801 and 803, multiple sets of wheels and rollers 202 can be distributed along the conveyor belts 201, and both the front and the rear plates 701 can be made of relatively flexible materials. In one embodiment, the conveyor belts 201 have a cushioned layer of thick rubber that helps to partially absorb the impact of a normal walking action on a foot and compensate for the potential unevenness of the underlying surface. With these tilted sections, a greater contact surface between the conveyors assemblies 803 coupled to a plate 701 in the heel area 106 and the underlying surface is obtained upon contact of the conveyor assemblies 803 with the underlying surface, as shown in FIG. 8B. Similarly, a greater contact surface between the conveyor assemblies 801 coupled to a plate 701 in the toe area 105 and the underlying surface is obtained when the conveyor assemblies 801 break contact with the underlying surface, as shown in FIG. 8C.

Figure 9:
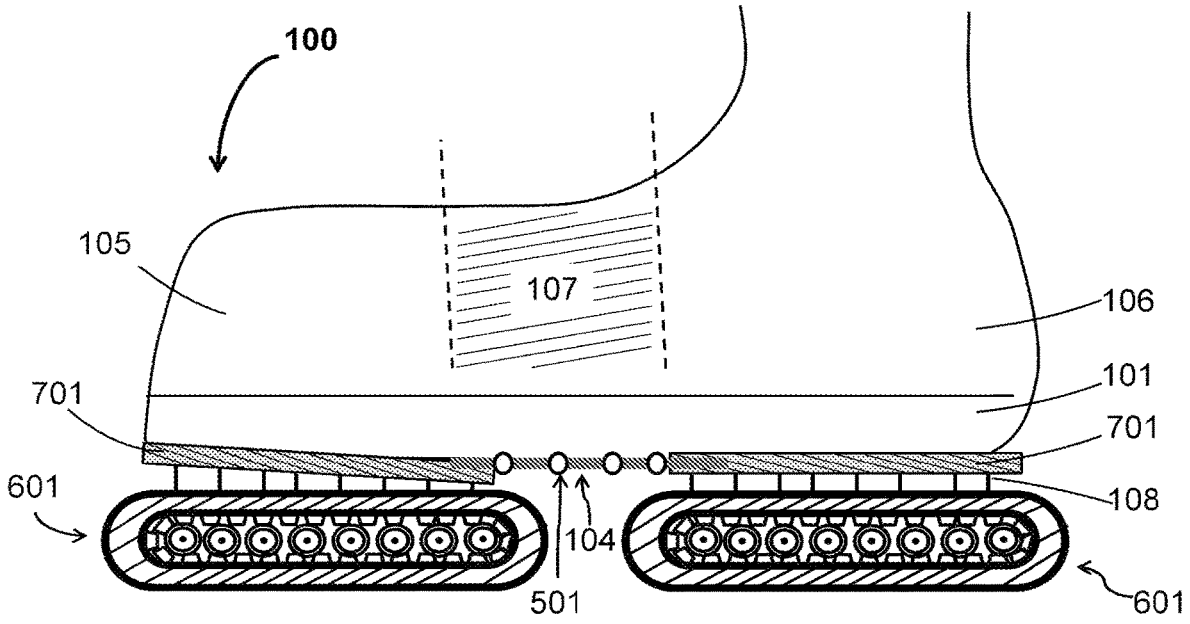
FIG. 9 illustrates a side elevation view of a shoe in accordance with an alternate embodiment of the present invention where the conveyor assemblies coupled to a plate in a heel area of the shoe comprise multiple sets of wheels or rollers, and wherein the plates are made of a same material while the flexible portion has multiple hinges.

In a further embodiment illustrated in FIG. 9, the flexible portion 104 with multiple hinges 501 is integrated to the embodiment wherein conveyor assemblies 601 with multiple sets of wheels or rollers 202 are coupled to the front and rear plates 701 that are made of relatively flexible materials, so that the plates 701 can be twisted or bent, or both, but to a lesser extent than the flexible portion 104. By integrating the flexible portion 104 with multiple hinges 501, which is more bendable than a flexible portion 104 without hinges 501, this embodiment assists in enlarging the contact surface between the conveyor assemblies 601 and the underlying surface while still allowing the shoe 100 to bend normally during a forward walking action.

Figure 10:
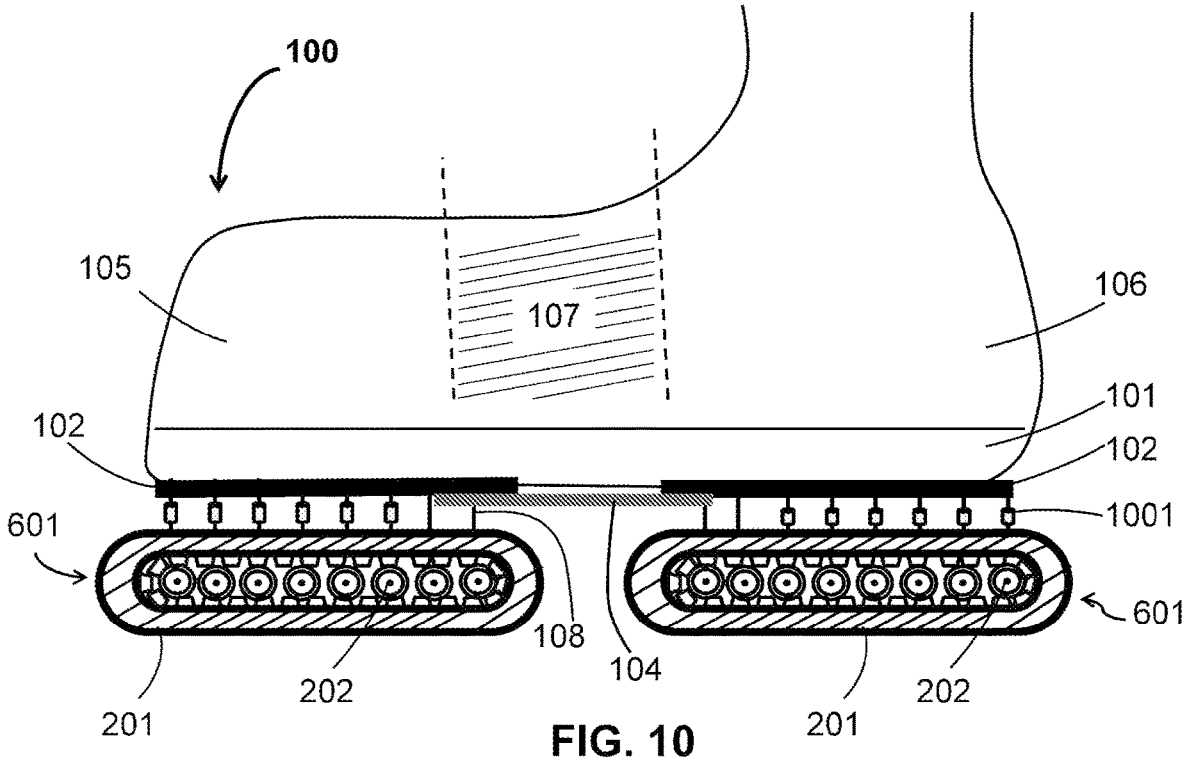
FIG. 10 illustrates a side elevation view of a shoe in accordance with an alternate embodiment of the present invention where the conveyor assemblies coupled to a plate in a heel area of the shoe comprise multiple sets of wheels or rollers, and wherein multiple shock absorbers, such as springs, are distributed along the conveyor assemblies.

In another embodiment, illustrated in FIG. 10, at least one of the mechanical means 108 used to couple either the front or rear conveyor assemblies 601, or both, to their respective plates 102 is a shock absorber 1001, such as a spring. More precisely, the shock absorber 1001 used to couple either the front or rear conveyor assemblies 601, or both, to their respective plates 102 connect the set of rollers or wheels 202 of the conveyor assemblies 601 to their respective plates 102. This way, the shock absorbers 1001 partially absorb the impact of a forward walking action on a foot and assist in enlarging the contact surface between the conveyor assemblies 601 and the underlying surface. A person skilled in the art would recognize that a variety of other shock absorbers could be integrated to this embodiment, such as viscoelastic dampers or progressive shock dampers.

In a further embodiment, the plate 701 in a toe area 105 of the shoe 100, the plate 701 in a heel area 106 of the shoe 100 and the flexible portion 104 are all bendable and twistable, yet made of different materials such that they are each bendable and twistable to different extents. Still, in this embodiment, the flexible portion 104 remains more bendable and twistable than the plate 701 in a toe area 105 of the shoe 100 and the plate 701 in a heel area 106 of the shoe 100.

The conveyor assemblies 103 coupled to the plate 102 in a toe area 105 of the shoe 100 and the conveyor assemblies 103 coupled to the plate 102 in a heel area 106 of the shoe 100 can respectively be of different or equal lengths, so long as each conveyor assembly 103 coupled to a same plate 102 are identical to each other to provide a balanced motion. Moreover, the conveyor assemblies 103 coupled to the plate 102 in a toe area 105 of the shoe 100 and the conveyor assemblies 103 coupled to the plate 102 in a heel area 106 of the shoe 100 can respectively be of different or equal widths, so long as each conveyor assembly 103 coupled to a same plate 102 are identical to each other to provide a balanced motion.

In any embodiment where the plates 701 are bendable or twistable, or both, the materials used in the plates 701 are sufficiently resilient to resist recurrent twisting or bending, or both, as a result of the impact of a forward walking action on a foot. Once torque is eliminated during a step, the partly bent or twisted plates 701 revert back to their standard shape. When a plate 701 bends or twists, the conveyor assemblies 103 that are coupled to that bended or twisted plate 701 are designed to continuously operate without any disruption. Moreover, the conveyor assemblies 103 can be flexible in order to adjust to any impact-related twist—which would last for only a very short period of time—and quickly revert back to their normal shape and position without their operation being disrupted once the pressure causing a twist drops in the forward walking action of the step.

Further, a person skilled in the art would recognize that the shape of the plates 102 or 701 and of the flexible portion 104 does not substantially affect the operation of the motorized walking shoes 100, depending on the shape of the sole 101. Consequently, the plates 102 or 701 and the flexible portion 104 can be rectangular, squared, circular, oval, arched, and so forth, and each of the plates 102 or 701 and the flexible portion 104 can have different shapes.

Mechanical Designs of the Shoes in an Alternate Embodiment

Figure 11:
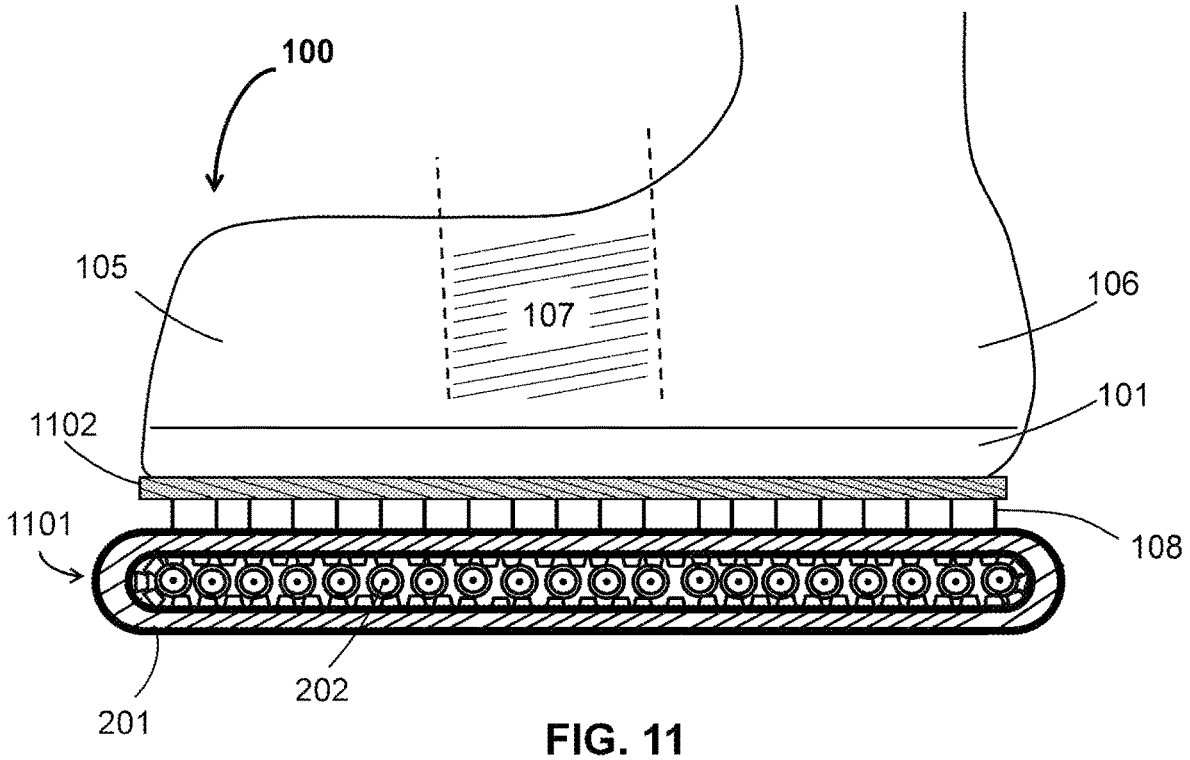
FIG. 11 illustrates a side elevation view of a shoe in accordance with an additional embodiment of the present invention where the conveyor assemblies of the shoe are coupled to a single plate made of flexible materials.

In an additional embodiment illustrated in FIG. 11, a single plate 1102 is connected to the sole 101 of each paired shoe 100, aligned longitudinally from the toe area 105 of the shoe 100 to the heel area 106 of the shoe 100. The single plate 1102 is coupled to at least one conveyor assembly 1101 or equivalent moving or propelling means also aligned longitudinally from the toe area 105 of the shoe 100 to the heel area 106 of the shoe 100. Mechanical means 108, such as hinges, anchors, nuts and bolts, screws, rivets and other fasteners known in the art, connect the conveyor assemblies 1101 to the single plate 1102. The single plate 1102 is made of a flexible material so that it can be twisted to a small extent or bent, or both. In addition, the conveyor assemblies 1101 that are coupled to the single plate 1102 preferably comprise multiple sets of wheels or rollers 202 in order to obtain a greater contact surface between the conveyor assemblies 1101 coupled to the single plate 1102 and the underlying surface. The preferred material of the single plate 1102 is determined so that it is twistable to a small extent or bendable, or both, while remaining sufficiently stiff to prevent substantial twisting. This way, the single plate 1102 cannot be twisted to a point that could potentially damage the shoe 100 when torque is applied upon contact of the shoe 100 with an underlying surface or when the shoe 100 is flexed repeatedly in the crumple zone 107. For instance, an overreaching twist of the single plate 1102 could disrupt the integrity of the distance between the sets of wheels or rollers 202. The single plate 1102 is made to withstand recurrent twisting to small extents and bending while yet reverting to its original shape once torque is eliminated. These features maintain the comfort of a natural forward walking action without negatively affecting the performance of the shoes 100. In this additional embodiment, motors, power storage, sensors, electronics and processing units in this embodiment work in the same way as in the principal embodiment previously described and illustrated in FIG. 2.

Figure 12A:
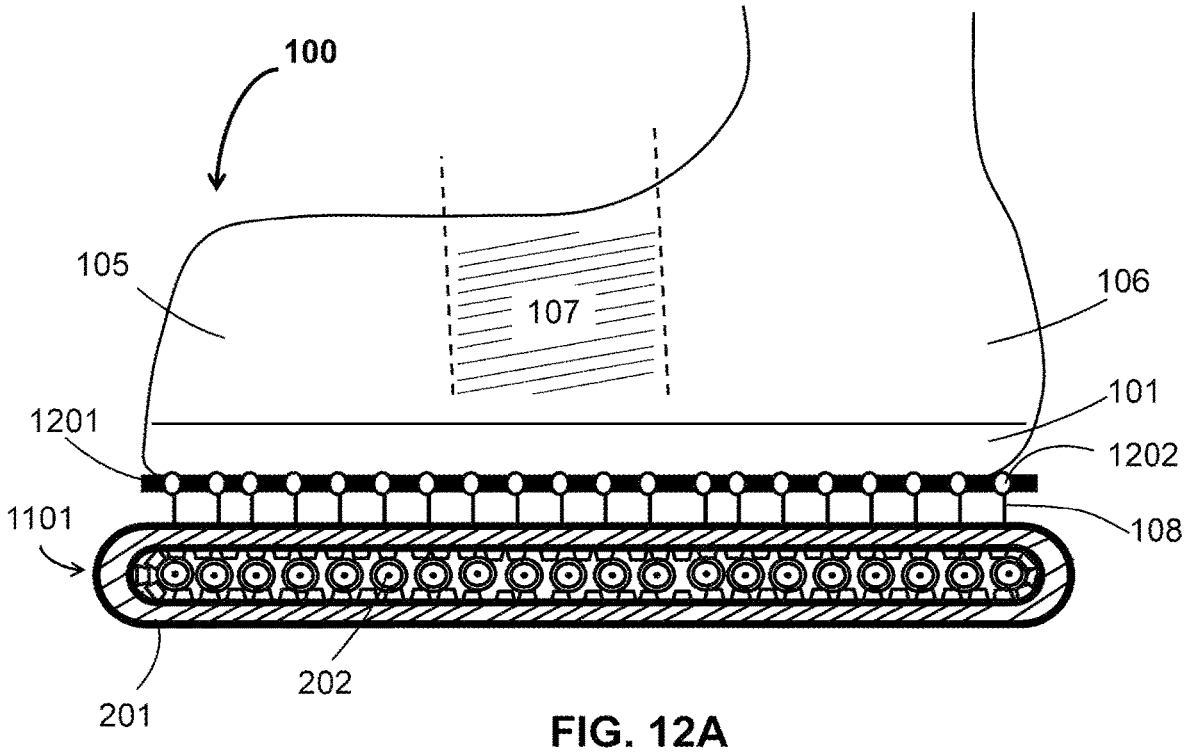
FIG. 12A illustrates a side elevation view of a shoe in accordance with a further additional embodiment of the present invention where the conveyor assemblies of the shoe are coupled through plate hinges to a single plate made of plate portions and plate hinges.
Figure 12B:
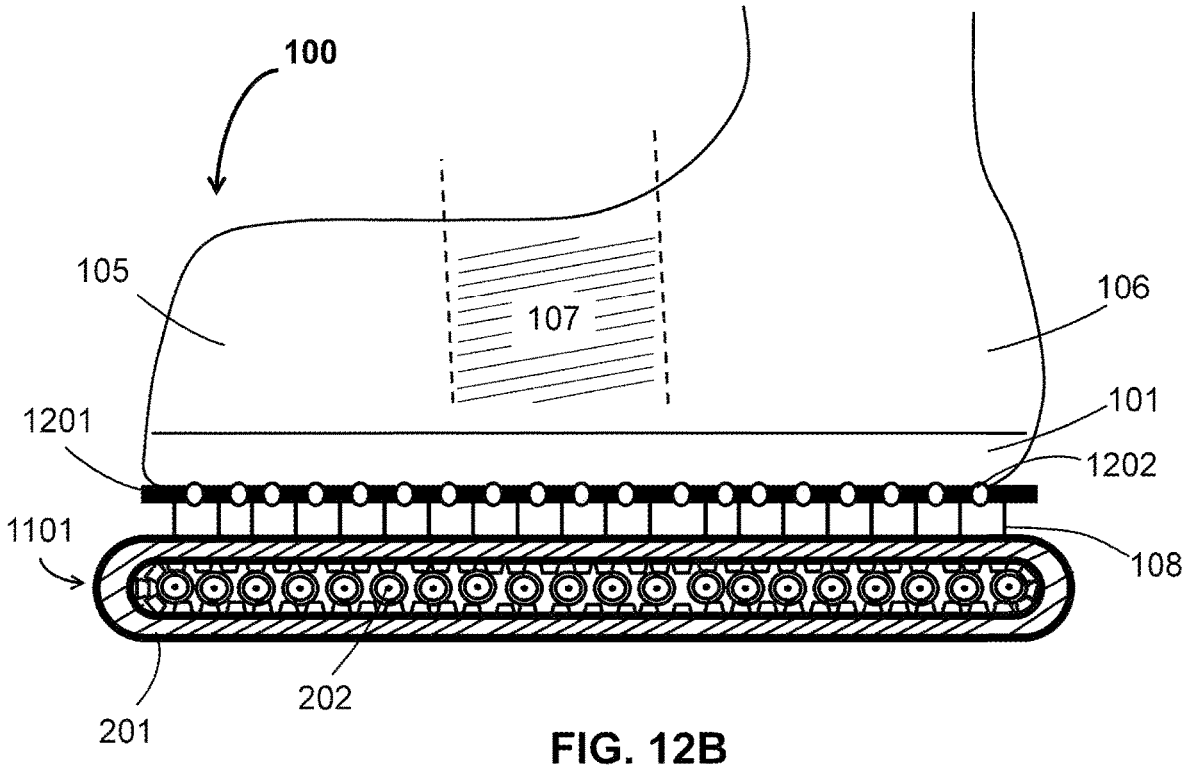
FIG. 12B illustrates a side elevation view of a shoe in accordance with a further additional embodiment of the present invention where the conveyor assemblies of the shoe are coupled through plate portions to a single plate made of plate portions and plate hinges.

In further additional embodiments illustrated in FIGS. 12A & 12B, a combination of plate portions 1201 and plate hinges 1202 constitute a single plate connected to the sole 101 of each paired shoe 100, aligned longitudinally from the toe area 105 of the shoe 100 to the heel area 106 of the shoe 100. The single plate made of a combination of plate portions 1201 and plate hinges 1202 is coupled to at least one conveyor assembly 1101 or equivalent moving or propelling means also aligned longitudinally from the toe area 105 of the shoe 100 to the heel area 106 of the shoe 100. Mechanical means 108, such as hinges, anchors, nuts and bolts, screws, rivets and other fasteners known in the art, connect the conveyor assemblies 1101 to the single plate made of a combination of plate portions 1201 and plate hinges 1202. In a first design of the present embodiments, illustrated in FIG. 12A, the mechanical means 108 are coupled to the single plate through a plurality or all of the plate hinges 1202. In a second design of the present embodiment, illustrated in FIG. 12B, the mechanical means 108 are coupled to the single plate through a plurality or all of the plate portions 1201.

Compared with the embodiment with a single plate 1102 made of a flexible material (FIG. 11), the plate portions 1201 can be made of flexible or non-flexible materials, such as plastic, since the plate hinges 1202 are sufficient to allow the single plate made of a combination of plate portions 1201 and plate hinges 1202 to bend. Should the plate portions 1201 be made of flexible materials (not shown), they remain bendable and twistable to a small extent for the shoe 100 to bend naturally during a forward walking action, but the plate hinges 1202 make bending easier than twisting. The conveyor assemblies 1101 that are coupled to the single plate made of a combination of plate portions 1201 and plate hinges 1202 preferably have multiple sets of wheels or rollers 202 in order to obtain a greater contact surface between the conveyor assemblies 1101 and the underlying surface. With the relative stiffness of the plate portions 1201, the single plate made of a combination of plate portions 1201 and plate hinges 1202 cannot be twisted to a point that could potentially damage the shoe 100 when torque is applied upon contact of the shoe 100 with an underlying surface or when the shoe 100 is flexed repeatedly in the crumple zone 107. For instance, a twist of the single plate made of a combination of plate portions 1201 and plate hinges 1202 could disrupt the integrity of the distance between the sets of wheels or rollers 202. The single plate made of a combination of plate portions 1201 and plate hinges 1202 is made to withstand recurrent bending while yet reverting to its original shape once torque is eliminated. These features maintain the comfort of a natural forward walking action without negatively affecting the performance of the shoes 100. In these further additional embodiments, motors, power storage, sensors, electronics and processing units in this embodiment work in the same way as in the principal embodiment previously described and illustrated in FIG. 2.

Because the conveyor assemblies 1101 or equivalent moving or propelling means are aligned longitudinally from the toe area 105 of the shoe 100 to the heel area 106 of the shoe 100 in the present additional embodiments, these embodiments are particularly useful in combination with conveyor assemblies 1101 that can bend, or equivalent moving or propelling means that can bend.

Speed of the Shoes

To describe the various embodiments related to setting and monitoring the speed of the motorized walking shoes 100 in accordance with this invention, four speed-related factors need to be distinguished. First, there is the "speed that is strictly contributed by the user's walking motion", $S_u$, which is the equivalent of the speed that a user would have by walking with normal, non-motorized shoes. Second, there is the "speed of the supplementary motion provided by the motorized walking shoes 100", $S_c$, which is equivalent to the additional speed contributed by the conveyor assemblies 103, 601, 1101 or equivalent moving or propelling means. Third, the sum of the speed that is strictly contributed by the user's walking motion and the speed of the supplementary motion provided by the motorized walking shoes 100 corresponds, in real time, to the "user's actual walking speed", $S_s$. Mathematically speaking, $S_{s,t}=S_{u,t}+S_{c,t}$, where t is a given time unit—for instance, a step or half a step.

Fourth and last, the speed of the supplementary motion provided by the motorized walking shoes 100 is determined, as further described below, by reference to a "user's intended walking speed", $S_i$. In a principal embodiment, the user's intended walking speed is governed by a preset parameter X that can be defined as a percentage increase of the actual speed that is strictly contributed by the user's walking motion, such that $S_{i,t}=S_{u,t}*X$. In one embodiment, the preset parameter X, or equivalent mathematical representations thereof, can be selected or adjusted electronically or remotely by the user. In a further embodiment, any preset parameter X for the speed of the conveyor assemblies 103, 601, 1101 can be reset and synchronized electronically or remotely. In a further embodiment, the conveyor assemblies 103, 601, 1101 can be switched on or off via a mechanical or electronic remote switch.

Since there is typically only one foot at a time that is active in a forward walking motion, the four speed variables defined above are assessed or calculated as an average speed, i.e., with respect to the user overall instead of applying to one of the paired shoes 100. In an alternate embodiment, the four speed factors defined above can be assessed or calculated with reference to proxy values, such as a curve inflection point.

While in a forward walking motion, the translation of the conveyor assemblies 103, 601, 1101 contributes to the distance traveled by the user, thereby effectively increasing the user's actual walking speed by the preset parameter X. In a principal embodiment, the speed of the supplementary motion provided by the motorized walking shoes 100 is thus meant to equal the difference between the user's intended walking speed and the speed that is strictly contributed by the user's walking motion. For example, let it be assumed that the preset parameter X is set at 150%, and $S_u$=6 km/hr at time $t_0$, meaning that the speed that is strictly contributed by the user's walking motion is 6 km/hr during the given time unit $t_0$. With this information, the processing units can compute that $S_i$=9 km/hr at time $t_0$, i.e., that the user intended to walk at a speed of 9 km/hr with the help of the shoes 100. In a basic embodiment of the present invention, the processing units would then prompt the motors 204 to adjust or maintain the speed of the supplementary motion provided by the motorized walking shoes 100, $S_c$, at 3 km/hr. This way, during the next time period starting at time $t_1$, the user's actual walking speed, $S_s$, would be 9 km/hr if the user keeps the same walking motion.

However, a change in the speed that is strictly contributed by the user's walking motion has to be detected before the speed of the supplementary motion provided by the motorized walking shoes 100 can be adjusted in accordance with the current user's intended walking speed. This delay creates a time discrepancy in the principal embodiment. Depending on a user's preferences, the speed of the supplementary motion provided by the motorized walking shoes 100 can be determined on the basis of discrete speed values or continuous speed values. Mathematically, when the speed of the supplementary motion provided by the motorized walking shoes 100 is determined continuously, $S_{c,t}=S_{i,t-1}—S_{u,t-1}=(X-1)\ S_{u,t-1}$. With respect to speed setting, the present invention's embodiments as disclosed herein focus on methods and configurations that enable near-immediate transitions of the supplementary motion provided by the motorized walking shoes 100 so that the user does not feel any delay between his or her intended walking speed and his or her actual walking speed.

While operating the present invention, the user's intended walking speed and the user's actual walking speed remain generally the same for two reasons. First, after three steps, users tend to keep a constant walking gait and pace until they are required to change their gait or pace due to an external factor, or until they reach their destination. For most steps, hence, it is mathematically the case that $S_{u,t-1}=S_{u,t}$. With the appropriate variable conversions, when $S_{u,t-1}=S_{u,t}$, it is necessarily the case that $S_{i,t}=S_{s,t}$. Second, it is one of this invention's purposes to reduce as much as possible the time duration of transitions by detecting as early as possible a change in the speed that is strictly contributed by the user's walking motion. With this invention's embodiments, a change in a user's intended walking speed can typically be deduced during the step where this change occurs, allowing the speed of the supplementary motion provided by the motorized walking shoes 100 to be adjusted even before that step is completed.

For safety reasons and to update the speed of the supplementary motion provided by the motorized walking shoes 100 with respect to the user's intended walking speed, it is crucial that the processing units keep track of the user's actual walking speed and identify the user's intended walking speed. This way, the speed of the supplementary motion provided by the motorized walking shoes 100 can be adjusted at any moment in accordance with the user's intended walking speed. In the principal embodiment of the present invention, sensors such as an accelerometer, an IR camera, IR sensors, a GPS tracking system and similar means and devices known in the art, or a combination thereof, can be integrated to the shoes 100, being located in the sole 101 of at least one of the shoes 100. When sensors comprise an accelerometer, the accelerometer can be reset at different intervals—such as at each step, at each five steps, at each ten steps, and so forth—in order to prevent misalignments and data misreadings. As an alternative, some or all of the sensors can be integrated in, or attached to, other clothing articles or accessories worn by the user, for instance, an electronic watch. The sensors can track either geographical information or information regarding the speed that is strictly contributed by the user's walking motion, or both. After communicating this data to one or multiple processing units also housed in the sole 101 of at least one of the shoes 100 (or housed in other clothing articles or accessories worn by the user), the processing units can assess or calculate, at specific time moments, the user's actual walking speed, the speed that is strictly contributed by the user's walking motion and the speed of the supplementary motion provided by the motorized walking shoes 100 when the motorized walking shoes 100 are in operation. Those speed factors can thus be tracked by the processing units.

In a principal embodiment, the conveyors assemblies 103, 601, 1101 or equivalent moving or propelling mechanisms housed in each shoe 100 are moving at the same speed and are synchronized.

In a general case, based on the information received from the sensors, the user's intended walking action, such as speeding up, slowing down or standing still, is deduced by the processing units. This deduction is made possible by tracking the speed that is strictly contributed by the user's walking motion. Since the supplementary motion provided by the motorized walking shoes 100 is synchronized for the paired shoes 100, the processing units can prompt the motors 204 to accelerate, decelerate, stop or maintain the speed of all conveyor assemblies 103 synchronously in response to updated measurements of the speed that is strictly contributed by the user's walking motion.

In a further embodiment, sensors attached to the upper part of the user's body can be used to deduce, with a very short response time, a change in the user's intended walking speed that happens during a step. Sensors attached to the upper part of the user's body can track the user's actual walking speed relative to the ground or sense body motions of the user. For example, a certain backward inclination of the upper part of the user's body or a sudden deceleration of the user's actual walking speed can be used as indicators of a user's intention to decelerate or stop. As a response to these indicators, the processing units housed in the shoes 100 can prompt the motors 204 to synchronously slow down or gradually stop the conveyor assemblies 103, 601, 1101 of both shoes 100. In one embodiment, this response can be effected gradually to the shoe 100 lying down on the underlying surface even before the completion of the step during which the change was deduced. In addition to reducing the lag between adjustments of the speed of the supplementary motion provided by the motorized walking shoes 100, a gradual adjustment of that speed effected to the shoe 100 lying down on the underlying surface allows smoother transitions.

In the mid-step of a user's walking motion, one of the paired shoes 100 is on the underlying surface while the other shoe 100 is in the air. Should the user intend to accelerate or decelerate in the current step and thus increase or decrease the speed that is strictly contributed by the user's walking motion, in order for the speed of the supplementary motion provided by the motorized walking shoes 100 to be adjusted accordingly before the end of the current step, the user's change in speed intention must be detected and assessed by the sensors and processing units before the step is completed. Otherwise, the motors 204 would not be adjusted immediately, nor would they be synchronized between the two shoes 100. In a principal embodiment, the speed of the supplementary motion provided by the shoe 100 lying on the underlying surface is entirely inherited from the user's intended walking speed from before the change of intention. In an alternate embodiment, the speed of the supplementary motion provided by the shoe 100 lying on the underlying surface is gradually adjusted upon deduction of a change of intention in the user's intended walking speed. The following embodiments of the present invention disclose methods by which the user's new intended walking speed can be detected and assessed, or calculated, before the completion of the step during which the user's change in intention occurred.

Acceleration and Relatively Constant Speed

In a basic embodiment for acceleration in the present invention, the speed of the supplementary motion provided by the motorized walking shoes 100 is meant to equal the difference between the user's intended walking speed and the speed that is strictly contributed by the user's walking motion.

A principal embodiment for acceleration is described with reference to the graphs 1301, 1302, 1303 and 1304 of FIG. 13A and graphs 1351, 1352, 1353 and 1354 of FIG. 13B. In a normal forward walking motion, sensors track or assess the speed that is strictly contributed by the user for each shoe 100 with respect to time, $t_1$. For instance, an accelerometer can be housed in the soles 101 of each of the shoes 100. Alternatively, this information can be assessed or calculated by the processing units using other types of information received from the sensors, for instance, geographical tracking. Data collection has shown that, in a normal forward walking action, for each foot, the speed that is strictly contributed by the user has a general bell curve as illustrated in the first graph 1301 of FIG. 13A: the foot first accelerates in the air, until it decelerates to a stop at the end of the step. The speed of a first shoe 100 is shown with a continuous line 1305, while the speed of a second shoe 100 is shown with a dashed line 1306. In a normal step, a first shoe 100 accelerates in the air and then decelerates to a rest position. In the next step, the second shoe 100 goes through the same cycle. By the definition of a forward walking action, only one shoe 100 at a time has a positive speed that is strictly contributed by the user.

In this principal embodiment, time units are defined as steps: $t_1$ is defined as the moment when the first step is completed by the first shoe 100; $t_2$ is defined as the moment when the second step is completed, this one by the second shoe 100, and so forth. In the example illustrated in the first graph 1301 of FIG. 13A, the user is standing still at to and then initiates a forward walking action. Data collection has shown that, upon initiating a normal forward walking action, a person typically accelerates during the first three steps before steadying.

Figure 13A:
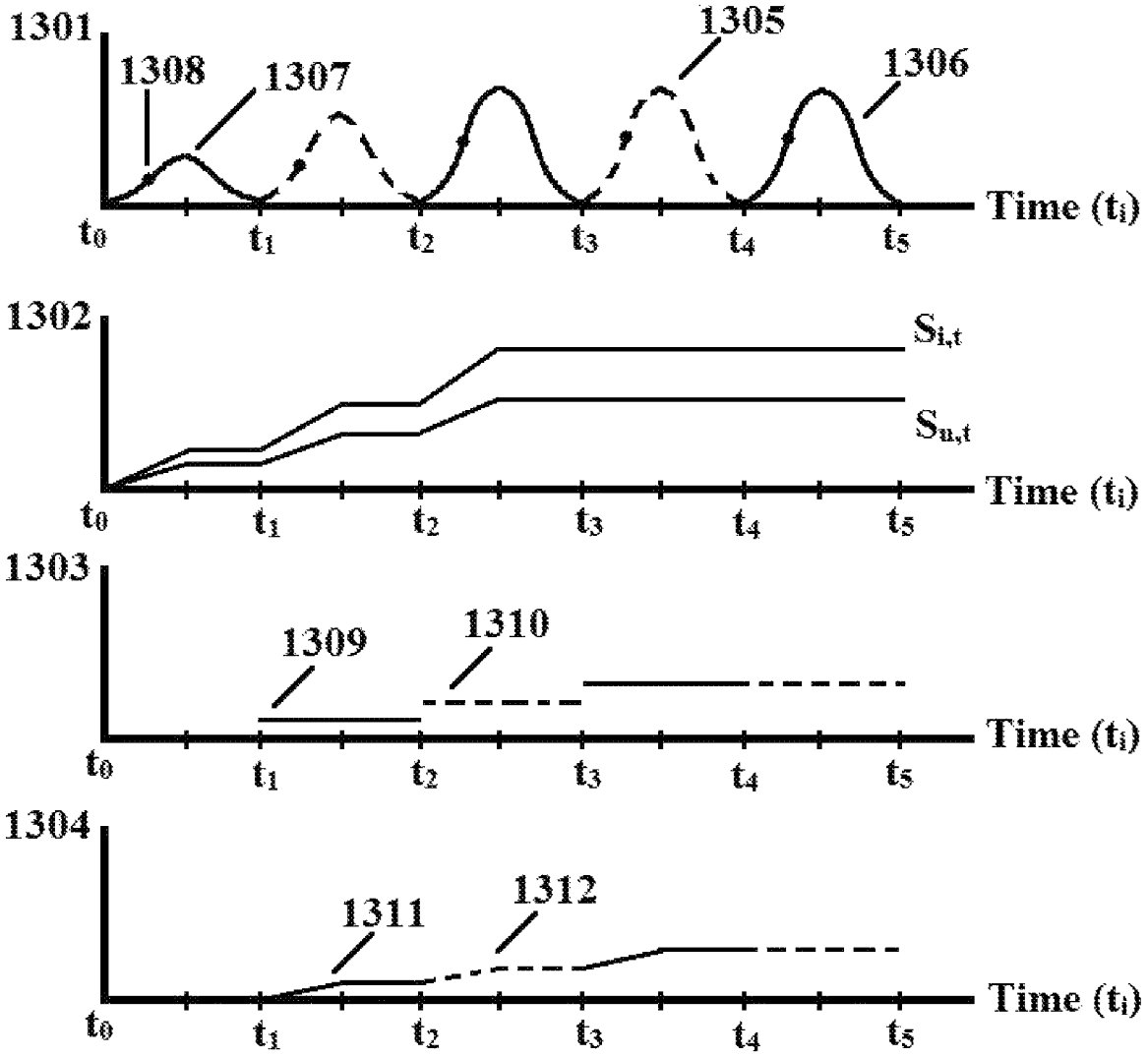
FIG. 13A illustrates graphs presenting curves of speed factors with respect to time in various embodiment for processes of acceleration or relatively constant speed.

The measurements 1305, 1306 of the speed that is strictly contributed by the user for each shoe 100 are used to assess and display the overall speed of the user that is strictly contributed by the user, $S_{u,t}$ in the second graph 1302 of FIG. 13A. As the user accelerates during the first three steps of the forward walking action depicted in the first graph 1301 of FIG. 13A, the overall speed of the user that is strictly contributed by the user, $S_{u,t}$, increases at each of those steps. Sensors can detect acceleration the moment that a shoe 100 is lifted, but they cannot immediately assess the overall speed level that will be reached for that step.

$S_{u,t}$ can be assessed by several ways. In one embodiment, $S_{u,t}$ for a given time unit is assessed or calculated with reference to the peak speed 1307 obtained by each shoe 100 during the current or previous step. In the first graph 1301 of FIG. 13A, data for peak speeds 1307 can be collected by the sensors at each mid-step. Because of the bell shape of curves associated with a normal forward walking action, the maximum speed of a shoe 100 for each step, represented in curves 1305 and 1306, is reached at mid-steps. In another embodiment, $S_{u,t}$ is assessed or calculated with reference to the left-side inflection points 1308 of the bells of curves 1305, 1306. The left-side inflection points 1308 represent the moments where the bells of curves 1305, 1306 switch from being convex to concave, i.e., the points where the left-side slopes of each bell stop increasing. Data collection has shown that, for a given step, left-side inflection points 1308 have a close correlation with the overall speed of the user that is strictly contributed by the user, $S_{u,t}$, for that same step. In a further embodiment, the speed of a shoe 100 at a left-side inflection point 1308 is used as a proxy of the overall speed of the user that is strictly contributed by the user, $S_{u,t}$, for that step. Whichever of these embodiments is used, by the time a shoe 100 reaches a mid-step, the processing units housed in each sole 101 are able to assess or calculate, for that step, the overall speed of the user that is strictly contributed by the user, $S_{u,t}$. Consequently, in the graphical representation of $S_{u,t}$ in FIG. 13A, the speed for each second half of a step remains steady. When the processing units assess or calculate the overall speed of the user that is strictly contributed by the user, $S_{u,t}$, with reference to inflection points 1308 for each step, that assessment can be processed between the moment that a left-side inflection point 1308 is observed and the mid-step. Therefore, in those embodiments, the graphical representation of $S_{u,t}$ could be constant, for each step, immediately after the moment each left-side inflection point 1308 is observed (not shown). A person skilled in the art would recognize that equivalent mathematical representations of peak speeds 1307 or left-side inflection points 1308 could be used to assess or calculate the overall speed of the user that is strictly contributed by the user, $S_{u,t}$.

The user's intended walking speed, $S_{i,t}$, can be computed by multiplying the speed of the user that is strictly contributed by the user, $S_{u,t}$, with the preset parameter X. For example, let it be assumed that the preset parameter X is set at 150%. With this simple multiplication, the user's intended walking speed, $S_{i,t}$, is plotted in the second graph 1302 of FIG. 13A.

Finally, the speed of the supplementary motion provided by the motorized walking shoes 100 is meant to equal the difference between the user's intended walking speed, $S_{i,t}$, and the speed that is strictly contributed by the user's walking motion, $S_{u,t}$. Various embodiments exist whereby the motors 204 in each shoe 100 synchronously adjust the speed of the supplementary motion provided by the motorized walking shoes 100, $S_{c,t}$.

In a first embodiment depicted in the third graph 1303 of FIG. 13A, the speed of the supplementary motion provided by the motorized walking shoes 100, $S_{c,t}$, is steady within each step and is equal to the difference between the user's intended walking speed, $S_{i,t}$, at the beginning of a given step and the speed that is strictly contributed by the user's walking motion, $S_{u,t}$, at the beginning of that same given step. Here as well, the speed of the first shoe 100 is shown with a continuous line 1309, while the speed of the second shoe 100 is shown with a dashed line 1310, and the shoe 100 that has a positive $S_{c,t}$ is always the one that is lying on the underlying surface. In the present embodiment, the speed of the supplementary motion provided by the motorized walking shoes 100 is determined at discrete intervals, at the beginning of each time unit. Although this embodiment involves relatively abrupt transitions that may destabilize some users, it features the benefit of more immediate speed adjustment.

In a second embodiment depicted in the fourth graph 1304 of FIG. 13A, the speed of the supplementary motion provided by the motorized walking shoes 100, $S_{c,t}$, is gradually adjusted on a continuous basis and is equal to the difference between the user's intended walking speed, $S_{i,t-1}$, at the previous time unit and the speed that is strictly contributed by the user's walking motion, $S_{u,t-1}$, at the previous time unit. As previously mentioned, in the present embodiment, $S_{c,t}=S_{i,t-1}-S_{u,t-1}=(X-1)\ S_{u,t-1}$. Here as well, the speed of the first shoe 100 is shown with a continuous line 1311, while the speed of the second shoe 100 is shown with a dashed line 1312, and the shoe 100 that has a positive $S_{c,t}$ is always the one that is lying on the underlying surface. Although this embodiment involves a greater lag before the user's actual walking speed equals the user's intended walking speed, $S_{i,t}$, it features smoother speed transitions.

Figure 13B:
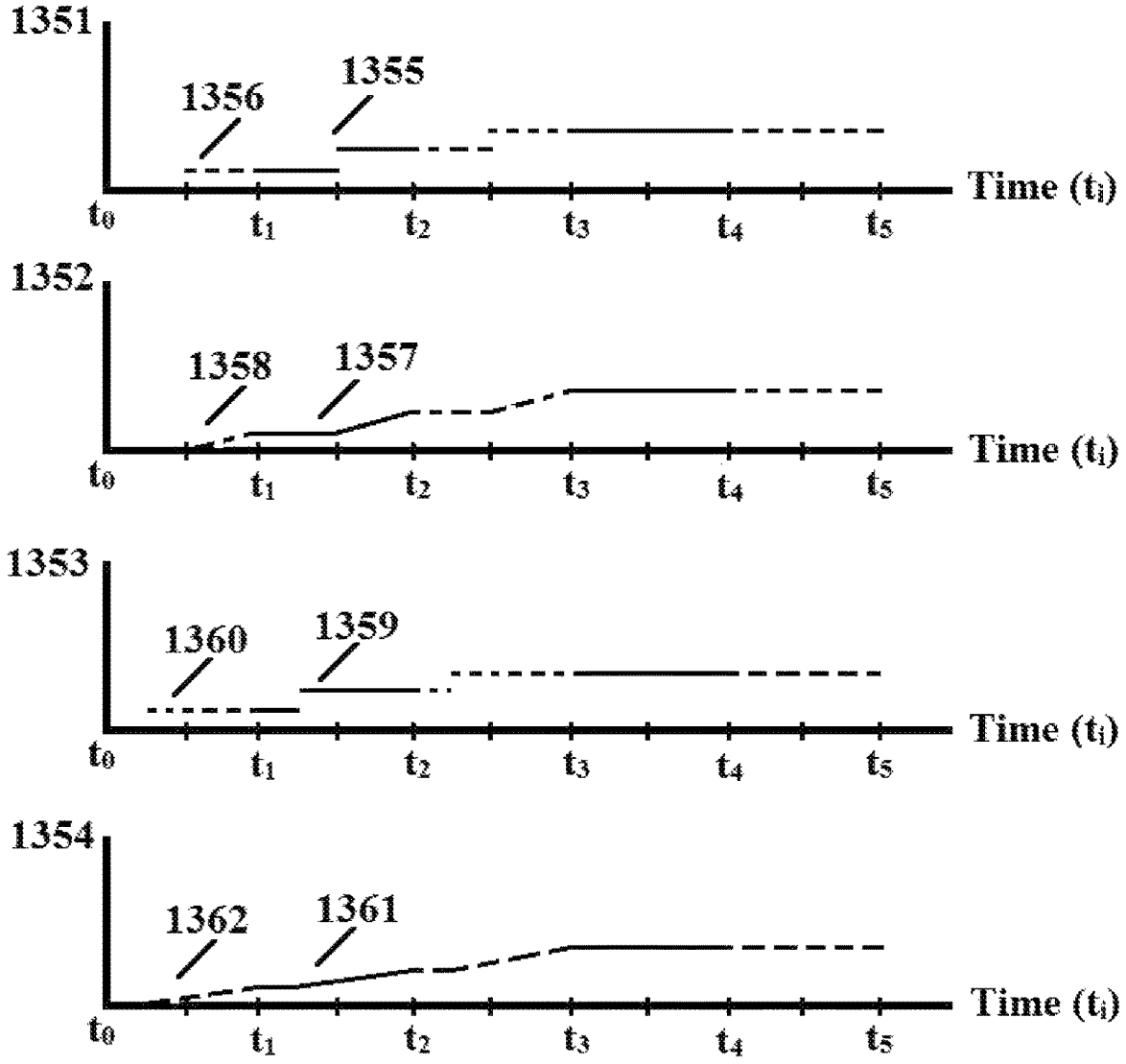
FIG. 13B illustrates graphs presenting curves of speed factors with respect to time in various additional embodiments for processes of acceleration or relatively constant speed.

In a third embodiment depicted in the first graph 1351 of FIG. 13B, $S_{u,t}$ for a given time unit is assessed or calculated with reference to the peak speeds 1307, and the speed of the supplementary motion provided by the motorized walking shoes 100, $S_{c,t}$, is immediately adjusted at each mid-step for the shoe 100 that is lying on the underlying surface. In the present embodiment, immediately upon assessment at a mid-step of a new intended speed by the user, the speed of the supplementary motion provided by the motorized walking shoes 100, $S_{c,t}$ becomes equal to the difference between the user's newly-assessed intended walking speed, $S_{i,t}$, at the mid-step and the overall speed that is strictly contributed by the user's walking motion, $S_{u,t}$, at the mid-step. Here as well, the speed of the first shoe 100 is shown with a continuous line 1355, while the speed of the second shoe 100 is shown with a dashed line 1356, and the shoe 100 that has a positive $S_{c,t}$ is always the one that is lying on the underlying surface. In the present embodiment, the speed of the supplementary motion provided by the motorized walking shoes 100, $S_{c,t}$ is determined at discrete intervals, at or around each mid-step. Although this embodiment involves abrupt transitions that may destabilize some users, it features the benefit of immediate speed adjustments and an overall faster performance level.

In a fourth embodiment depicted in the second graph 1352 of FIG. 13B, $S_{u,t}$ for a given time unit is assessed or calculated with reference to the peak speeds 1307, and the speed of the supplementary motion provided by the motorized walking shoes 100, $S_{c,t}$, is gradually adjusted for the shoe 100 that is lying on the underlying surface, the gradual adjustment starting at or around each mid-step. In the present embodiment, immediately upon assessment of a new intended speed by the user, the speed of the supplementary motion provided by the motorized walking shoes 100, $S_{c,t}$, is gradually adjusted so that, by the time the current step is completed, it becomes equal to the difference between the user's newly-assessed intended walking speed, $S_{i,t}$, at the mid-step and the overall speed that is strictly contributed by the user's walking motion, $S_{u,t}$, at the mid-step. Here as well, the speed of the first shoe 100 is shown with a continuous line 1357, while the speed of the second shoe 100 is shown with a dashed line 1358, and the shoe 100 that has a positive $S_{c,t}$ is always the one that is lying on the underlying surface. Although this embodiment is relatively slower than the previous embodiment, it features smoother speed transitions.

In a fifth embodiment depicted in the third graph 1353 of FIG. 13B, $S_{u,t}$ for a given time unit is assessed or calculated with reference to the left-side inflection points 1308, and the speed of the supplementary motion provided by the motorized walking shoes 100, $S_{c,t}$, is immediately adjusted (for the shoe 100 that is lying on the underlying surface) at the moment that each left-side inflection point 1308 is observed. In the present embodiment, immediately upon assessment of a new intended speed by the user, the speed of the supplementary motion provided by the motorized walking shoes 100, $S_{c,t}$, becomes equal to the difference between the user's newly-assessed intended walking speed, $S_{i,t}$, at the moment the left-side inflection point 1308 is observed and the overall speed that is strictly contributed by the user's walking motion, $S_{u,t}$, at the moment the left-side inflection point 1308 is observed. Here as well, the speed of the first shoe 100 is shown with a continuous line 1359, while the speed of the second shoe 100 is shown with a dashed line 1360, and the shoe 100 that has a positive $S_{c,t}$ is always the one that is lying on the underlying surface. In the present embodiment, the speed of the supplementary motion provided by the motorized walking shoes 100, $S_{c,t}$, is determined at discrete intervals, at or around observations of each left-side inflection point 1308. Although this embodiment involves abrupt transitions that may destabilize some users, it features the benefit of immediate speed adjustments and an overall faster performance level.

In a sixth embodiment depicted in the fourth graph 1354 of FIG. 13B, $S_{u,t}$ for a given time unit is assessed or calculated with reference to the left-side inflection points 1308, and the speed of the supplementary motion provided by the motorized walking shoes 100 is gradually adjusted (for the shoe 100 that is lying on the underlying surface) from the moment that a left-side inflection point 1308 is observed. In the present embodiment, immediately upon assessment of a new intended speed by the user, the speed of the supplementary motion provided by the motorized walking shoes 100, $S_{c,t}$, is gradually adjusted so that, by the time the current step is completed, it becomes equal to the difference between the user's newly-assessed intended walking speed, $S_{i,t}$, at the moment the left-side inflection point 1308 is observed and the overall speed that is strictly contributed by the user's walking motion, $S_{u,t}$, at the moment the left-side inflection point 1308 is observed. Here as well, the speed of the first shoe 100 is shown with a continuous line 1361, while the speed of the second shoe 100 is shown with a dashed line 1362, and the shoe 100 that has a positive $S_{c,t}$ is always the one that is lying on the underlying surface. Although this embodiment is relatively slower than the previous embodiment, it features smoother speed transitions.

With respect to the six aforementioned embodiments whereby the speed of the supplementary motion provided by the motorized walking shoes 100, $S_{c,t}$, is adjusted, the adjustments can take place over longer periods than those graphically illustrated in FIGS. 13A & 13B. In one embodiment, the speed adjustments take place over a fixed duration, for instance, a certain number of time units or a certain number of steps for every adjustment. In another embodiment, there is a maximum change in speed per step for the supplementary motion provided by the motorized walking shoes 100, $S_{c,t}$, necessitating that important speed adjustments of the supplementary motion provided by the motorized walking shoes 100, $S_{c,t}$, take place over more than one step. In another embodiment, the user can select, based on his or her preferences, the time period over which adjustments of the speed of the supplementary motion provided by the motorized walking shoes 100, $S_{c,t}$, take place. In another embodiment, the user can choose a cap in the change in speed per step for the supplementary motion provided by the motorized walking shoes 100, $S_{c,t}$.

In one embodiment, the system that determines the speed of the supplementary motion provided by the motorized walking shoes 100, $S_{c,t}$, is left to the user's discretion, based on his or her preferences. A variety of options can be offered to the user, including the six embodiments just disclosed above and other basic variations described in the present description or known in the art. A user who wishes to maximize speed is likely to prefer an embodiment whereby speed adjustments are immediate, while users with higher risks of injury are likely to favor smoother speed transitions. Similarly, in one embodiment, the user can select the percentage associated with the preset parameter X.

It should be noted that all of the aforementioned embodiments with respect to speed are sufficient to describe speed-related processes of the present invention when the shoes 100 are accelerating or maintained at a more or less constant speed. Although those embodiments can also apply to substantial decelerations, they can entail problems with respect to safety and security, for instance, because of the presence of an obstacle ahead or collision risks. In circumstances of substantial deceleration, there is a greater need for balance and swift adjustments of the speed of the supplementary motion provided by the motorized walking shoes 100. In order to prevent those problems, the following alternate embodiments can be implemented with respect to the speed of the shoes 100 when a user is substantially decelerating or immobilizing.

Substantial Deceleration and Immobilization

In accordance with the present invention, the processing units housed in the soles 101 of the paired shoes 100, which communicate wirelessly with each other and with the sensors, can deduce a user's intention to substantially decelerate or immobilize on the basis of the information received from the sensors. The motors 204 are then prompted to substantially decrease the speed of the supplementary motion provided by the motorized walking shoes 100 or bring the supplementary motion to a stop.

Figure 14:
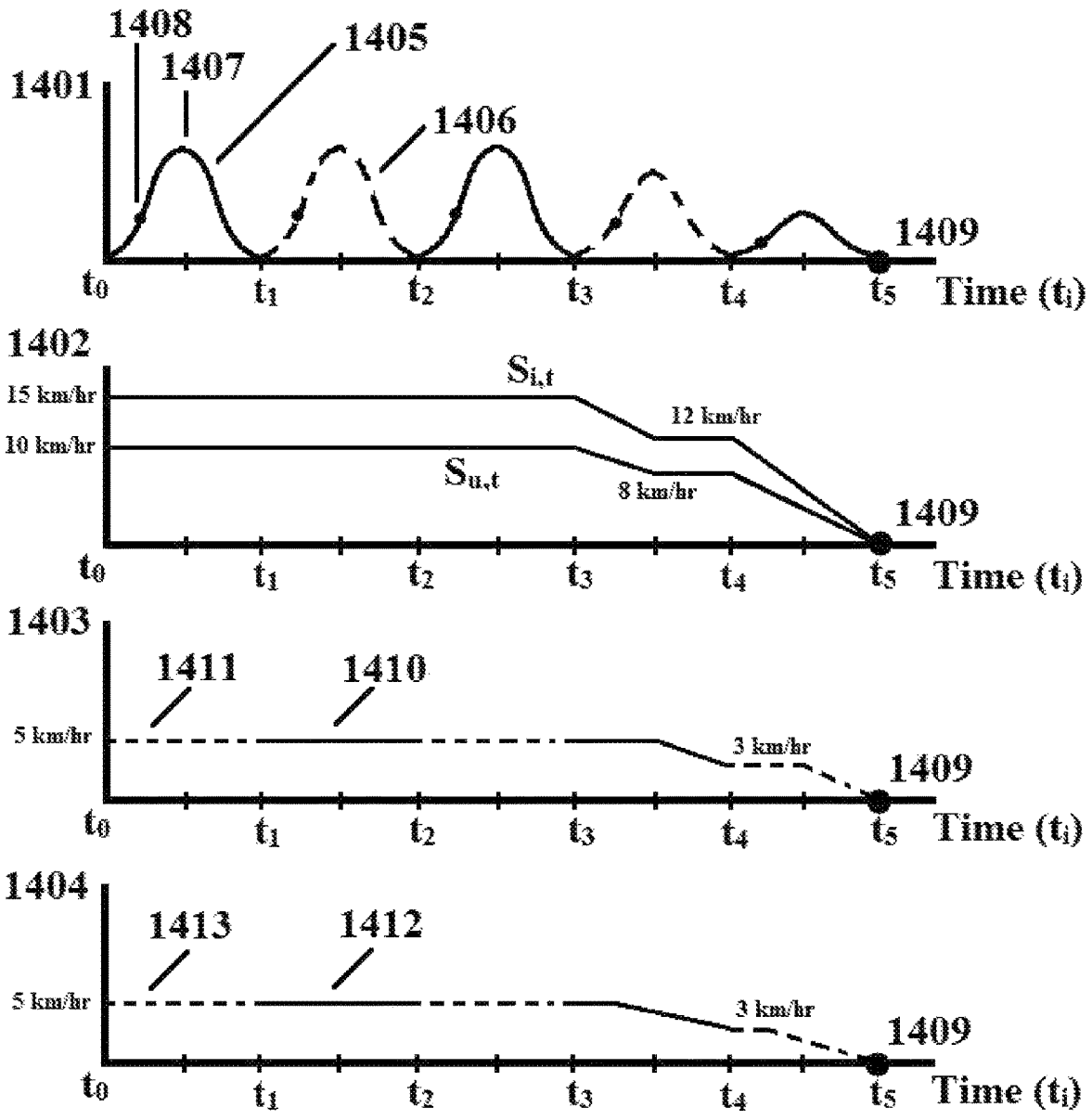
FIG. 14 illustrates graphs presenting curves of speed factors with respect to time in a principal embodiment for processes of substantial deceleration or immobilization.

A principal embodiment for substantial deceleration and immobilization is described with reference to the graphs 1401, 1402, 1403 and 1404 of FIG. 14A. As in the embodiments related to acceleration or relatively constant speed, sensors track or assess the speed that is strictly contributed by the user for each shoe 100 with respect to time, t 1. For instance, an accelerometer can be housed in the soles 101 of each of the shoes 100. Alternatively, this information can be assessed or calculated by the processing units using other types of information received from the sensors, for instance, geographical tracking. For deceleration and immobilization as well, data collection has shown that, in a normal forward walking action, for each foot, the speed that is strictly contributed by the user has a general bell curve as illustrated in the first graph 1401 of FIG. 14A. The speed of a first shoe 100 is shown with a continuous line 1405, while the speed of a second shoe 100 is shown with a dashed line 1406.

In this principal embodiment, time units are defined as steps: $t_1$ is defined as the moment when the first step is completed by the first shoe 100; $t_2$ is defined as the moment when the second step is completed, this one by the second shoe 100, and so forth. In the example illustrated in the first graph 1401 of FIG. 14A, the user has been walking at a steady rhythm at to and eventually initiates a substantial deceleration at $t_3$, with the intent of immobilizing and reaching a complete stop 1409 at $t_5$. Data collection has shown that when a user substantially decelerates, the new intended speed is typically reached in two steps. Those statistical observations also apply to immobilizations.

The measurements 1405, 1406 of the speed that is strictly contributed by the user for each shoe 100 are used to assess and display the overall speed of the user that is strictly contributed by the user, $S_{u,t}$, in the second graph 1402 of FIG. 14A. As the user decelerates during the fourth and fifth steps of the forward walking action depicted in the first graph 1401 of FIG. 14A, the overall speed of the user that is strictly contributed by the user, $S_{c,t}$, decreases at each of those steps. Sensors can detect deceleration with respect to the previous step the moment that a shoe 100 is lifted, but they cannot immediately assess the overall speed level that will be reached for that step.

As in the processes for acceleration and constant speed, $S_{u,t}$ can be assessed or calculated with reference to the peak speed 1407 or to left-side inflection points 1408. In one embodiment, the speed of a shoe 100 at a left-side inflection point 1408 is used as a proxy of the overall speed of the user that is strictly contributed by the user, $S_{c,t}$, for that step. A person skilled in the art would recognize that equivalent mathematical representations of peak speeds 1407 or left-side inflection points 1408 could be used to assess or calculate the overall speed of the user that is strictly contributed by the user, $S_{u,t}$. Whichever of these sets of data are sensed and used, by the time a shoe 100 reaches a mid-step, the processing units housed in each sole 101 are able to assess or calculate, for that step, the overall speed of the user that is strictly contributed by the user, $S_{u,t}$. Consequently, in the graphical representation of $S_{u,t}$ in the second graph 1402 of FIG. 14A, the speed for each second half of a step remains steady for the first four steps. As illustrated in the graphical representation of $S_{u,t}$ in FIG. 14A, the final step before a complete stop 1409 is different in that the overall speed of the user that is strictly contributed by the user, $S_{u,t}$, for that step, keeps decreasing until the step is completed and the user immobilizes.

When the processing units assess or calculate the overall speed of the user that is strictly contributed by the user, $S_{u,t}$, with reference to inflection points 1408 for each step, that assessment can be processed between the moment that a left-side inflection point 1408 is observed and the mid-step. Therefore, in those embodiments, the graphical representation of $S_{u,t}$ could be constant, for each of the first four steps, immediately after the moment each left-side inflection point 1408 is observed (not shown). In this case as well, the overall speed of the user that is strictly contributed by the user, $S_{u,t}$, for the final step before a complete stop 1409, keeps decreasing until the step is completed and the user stops.

As previously mentioned, the user's intended walking speed, $S_{i,t}$, can be computed by multiplying the overall speed of the user that is strictly contributed by the user, $S_{u,t}$, with the preset parameter X. For example, let it be assumed that the preset parameter X is set at 150%. With this simple multiplication, the user's intended walking speed, $S_{i,t}$, is plotted in the second graph 1402 of FIG. 14A.

In a principal embodiment for deceleration and immobilization, a substantial deceleration is defined by a preset parameter Y1, a percentage of the overall speed of the user that is strictly contributed by the user, $S_{u,t}$. For example, let it be assumed that the preset parameter Y1 is set at 20%. If, for a given step, the overall speed of the user that is strictly contributed by the user, $S_{u,t}$ is reduced with respect to the previous step by at least the preset parameter Y1, an event of substantial deceleration is deduced by the processing units. When an event of substantial deceleration is detected, the various applicable processes with respect to acceleration and relatively constant speed are overridden by a particular process for substantial deceleration. In the present embodiment, that process entails that when an event of substantial deceleration is detected for a given step, the speed of the supplementary motion provided by the motorized walking shoes 100, $S_{c,t}$ is reduced by a preset percentage parameter Y2, which is greater than the multiplication of the preset parameters X and Y1. For example, let it be assumed that Y2=200%*Y1=40%. Hence, in this case, when an event of substantial deceleration is detected for a given step, the reduction of the speed of the supplementary motion provided by the motorized walking shoes 100, $S_{c,t}$ is equal to twice the percentage of the speed reduction of the overall speed of the user that is strictly contributed by the user, $S_{u,t}$.

With these settings, it is certain that the speed of the supplementary motion provided by the motorized walking shoes 100, $S_{c,t}$, will be more reduced in case of a substantial deceleration than with the processes related to acceleration and relatively constant speed. Therefore, the shoes 100 are more responsive to a user's sudden intent to substantially decelerate, for instance because of the presence of an obstacle ahead or of collision risks.

In a numerical example with values referred to in FIG. 14A, let it be assumed, that at $t_3$, the overall speed of the user that is strictly contributed by the user, $S_{u,t}$ is 10 km/hr, and the user reduces that speed to 8 km/hr in the next step. In accordance with the embodiments described above with respect to acceleration and relatively constant speeds, and considering that the preset parameter X is equal to 150%, the user's intended walking speed, $S_{i,t}$, would be 15 km/hr at $t_3$, and 12 km/hr once the speed adjustments in the fourth step have been completed. In the embodiments described above with respect to acceleration and relatively constant speeds, the speed of the supplementary motion provided by the motorized walking shoes 100 is meant to be equal to the difference between the user's intended walking speed, $S_{i,t}$, and the overall speed of the user that is strictly contributed by the user, $S_{u,t}$. As a result (not shown), the speed of the supplementary motion provided by the motorized walking shoes 100 would be 5 km/hr at $t_3$, and 4 km/hr once the speed adjustments in the fourth step have been completed.

In accordance with the present embodiment for substantial deceleration and immobilization, an event of substantial deceleration would be detected in the fourth step since the overall speed of the user that is strictly contributed by the user, $S_{u,t}$, is reduced by 20%, the threshold set by the preset parameter Y1 in this example. As a result, the speed of the supplementary motion provided by the motorized walking shoes 100 would be synchronously and gradually reduced by the preset parameter Y2, 40% in the present case.

The gradual and synchronous reduction of the speed of the supplementary motion provided by the motorized walking shoes 100, $S_{c,t}$, is graphically illustrated in the third and fourth graphs 1403, 1404 of FIG. 14A. In the third graph 1403 of FIG. 14A, $S_{u,t}$ for a given time unit is assessed or calculated with reference to the peak speeds 1407, so adjustments in the speed of the supplementary motion provided by the motorized walking shoes 100, $S_{c,t}$, gradually start at or around each mid-step. The speed of the first shoe 100 is shown with a continuous line 1410, while the speed of the second shoe 100 is shown with a dashed line 1411, and the shoe 100 that has a positive $S_{c,t}$ is always the one that is lying on the underlying surface. In the fourth graph 1404 of FIG. 14A, $S_{u,t}$ for a given time unit is assessed or calculated with reference to the left-side inflection points 1408, so adjustments in the speed of the supplementary motion provided by the motorized walking shoes 100, $S_{c,t}$, gradually start at or around each observation of a left-side inflection point 1408. The speed of the first shoe 100 is shown with a continuous line 1412, while the speed of the second shoe 100 is shown with a dashed line 1413, and the shoe 100 that has a positive $S_{c,t}$ is always the one that is lying on the underlying surface. As illustrated in the third and fourth graphs 1403, 1404 of FIG. 14A, in application of the present embodiment, the supplementary motion provided by the motorized walking shoes 100 would decrease from 5 km/hr to 3 km/hr by the end of the fourth step instead of 4 km/hr as in the embodiments related to acceleration and relatively constant speeds.

In the present embodiment, an event of immobilization is detected should one of three events occur. In a first scenario, an event of immobilization is detected if an event of substantial deceleration is detected for two consecutive steps. In a second scenario, an event of immobilization is detected if the overall speed of the user that is strictly contributed by the user, $S_{u,t}$, is reduced by a preset parameter Z1 over the length of two consecutive steps. For example, let it be assumed that the preset parameter Z1 is set at 40%. If the overall speed of the user that is strictly contributed by the user, $S_{u,t}$, is reduced respectively by 15% and 25% over two consecutive steps, an event of immobilization would not be triggered under the first scenario but would be triggered in accordance with the present second scenario. In a third scenario, an event of immobilization is detected if the overall speed of the user that is strictly contributed by the user, $S_{u,t}$, is reduced below a preset parameter Z2 in absolute speed value. For example, let it be assumed that the preset parameter Z2 is set at 2 km/hr.

In FIG. 14A, the overall speed of the user that is strictly contributed by the user, $S_{u,t}$, is reduced by at least 20% in the user's fifth step starting at t 4, thus constituting an event of immobilization under the first scenario. When an event of immobilization is detected, the various applicable processes with respect to acceleration and relatively constant speed or substantial deceleration are overridden by a particular process for immobilization. In the present embodiment, that process entails that when an event of immobilization is detected for a given step, the speed of the supplementary motion provided by the motorized walking shoes 100, $S_{c,t}$ is gradually and synchronously reduced to zero by the time the step is completed, as illustrated in the third and fourth graphs 1403, 1404 of FIG. 14A.

When an event of substantial deceleration is detected within a step, the particular process that determines the speed of the supplementary motion provided by the motorized walking shoes 100, $S_{c,t}$, overrides, for that step, the speed-setting processes related to acceleration and relatively constant speed. Should no event of substantial deceleration or immobilization be detected in the step immediately subsequent to a step where an event of substantial deceleration was detected, the speed of the supplementary motion provided by the motorized walking shoes 100, $S_{c,t}$, is gradually and synchronously adjusted back to the speed values applicable to processes related to acceleration and relatively constant speed (not shown).

Finally, in one embodiment, the processes that determine, in case of substantial decelerations or immobilizations, the speed of the supplementary motion provided by the motorized walking shoes 100, $S_{c,t}$, is left to the user's discretion, based on his or her preferences. Moreover, the preset parameters Y1, Y2, Z1 and Z2 can be determined or adjusted by the user. With respect to the aforementioned embodiments whereby the speed of the supplementary motion provided by the motorized walking shoes 100, $S_{c,t}$, is adjusted as a response to a substantial deceleration or an immobilization of the user, the adjustments can take place over longer periods than those graphically illustrated in FIG. 14. In one embodiment, the speed adjustments take place over a fixed duration, for instance, a certain number of time units or a certain number of steps for every adjustment. In another embodiment, there is a maximum change in speed per step for the supplementary motion provided by the motorized walking shoes 100, $S_{c,t}$, necessitating that important speed adjustments of the supplementary motion provided by the motorized walking shoes 100, $S_{c,t}$, take place over more than one step. In another embodiment, the user can select, based on his or her preferences, the time period over which adjustments of the speed of the supplementary motion provided by the motorized walking shoes 100, $S_{c,t}$, take place. In another embodiment, the user can choose a cap in the change in speed per step for the supplementary motion provided by the motorized walking shoes 100, $S_{c,t}$.

While this invention has been particularly shown and described with reference to an exemplary embodiment and alternate and additional embodiments, it will be understood by those skilled in the art that various changes in form and detail may be made therein without departing from the spirit and scope of the invention. The invention in its broadest, and more specific aspects, is further described and defined in the claims which now follow.

The invention claimed is:

1. A pair of powered motorized shoes to provide an increase in a user's walking speed by a translation motion while the user is walking, wherein each of the shoes comprises at least one motorized mechanism coupled to at least one bendable plate to allow bending the shoes during a walking action.

2. A pair of powered motorized shoes as claimed in claim 1, wherein the at least one motorized mechanism comprises a plurality of sets of rollers or wheels wrapped over and clasped by a conveyor belt.

3. A pair of powered motorized shoes as claimed in claim 1, wherein the at least one motorized mechanism coupled to a at least one bendable plate are aligned substantially parallel to each other and oriented along a direction from the toe area to the heel area of the shoe.

4. A pair of powered motorized shoes to provide an increase in a user's walking speed by a translation motion while the user is walking, wherein each of the shoes comprises at least one plate that is bendable as the user is walking and at least one motorized mechanisms connected to the plate that are able to bend with the plate during the user's walking.

5. A pair of powered motorized shoes to provide an increase in a user's walking speed by a translation motion while the user is walking, wherein each of the shoes comprises at least one plate and at least one motorized mechanism, and wherein the plate is bendable.

6. A pair of powered motorized shoes to provide an increase in a user's walking speed by a translation motion while the user is walking, wherein each of the shoes comprises at least one plate and at least one motorized mechanism, and wherein the plate is twistable.

7. A pair of powered motorized shoes to provide an increase in a user's walking speed by a translation motion while the user is walking, wherein each of the shoes comprises at least one plate and at least one motorized mechanism, wherein the plate is both bendable and twistable, and wherein the twistability of the at least one plate is limited to be less than its respective bendability.

8. A pair of powered motorized shoes to provide an increase in a user's walking speed by a translation motion while the user is walking, wherein each of the shoes comprises:

at least one motorized mechanism coupled to a plate in a toe area;

at least one motorized mechanism coupled to a plate in a heel area; and a flexible portion between the toe area and the heel area of each of the shoes, wherein the flexible portion connects the plates of each of the shoes together to allow bending the shoes during a walking action.

9. A pair of powered motorized shoes to provide an increase in a user's walking speed by a translation motion while the user is walking, wherein the sole of each of the shoes comprise at least one plate which is bendable in the longitudinal direction between a toe area of the shoe and a heel area of the shoe, and which is also bendable in the orthogonal direction to the toe and heel areas, and wherein the amount of bending under a applied force is more in the longitudinal direction than in the orthogonal direction.

* * * * *